US009010759B2

(12) United States Patent
McDonnell

(10) Patent No.: US 9,010,759 B2
(45) Date of Patent: Apr. 21, 2015

(54) DRINKING GAME CUP OR ATTACHMENT WITH MAGNETIC ALIGNMENT PAD

(71) Applicant: Sean Michael McDonnell, Burlington, CT (US)

(72) Inventor: Sean Michael McDonnell, Burlington, CT (US)

( * ) Notice: Subject to any disclaimer, the term of this patent is extended or adjusted under 35 U.S.C. 154(b) by 0 days.

(21) Appl. No.: 13/687,159

(22) Filed: Nov. 28, 2012

(65) Prior Publication Data

US 2013/0134677 A1 May 30, 2013

Related U.S. Application Data

(60) Provisional application No. 61/564,282, filed on Nov. 28, 2011.

(51) Int. Cl.

| | |
|---|---|
| ***A63B 67/00*** | (2006.01) |
| ***A63B 63/00*** | (2006.01) |
| ***A63B 7/00*** | (2006.01) |
| ***A63F 9/00*** | (2006.01) |
| *A63F 3/00* | (2006.01) |

(52) U.S. Cl.

CPC ..... *A63F 9/00* (2013.01); *A63F 2003/00738* (2013.01); *A63F 2003/00927* (2013.01); *A63F 2009/0058* (2013.01)

(58) Field of Classification Search

USPC ..... 273/309, 342, 400–402; 473/496; 108/25

See application file for complete search history.

(56) References Cited

U.S. PATENT DOCUMENTS

| | | | | |
|---|---|---|---|---|
| 3,285,456 | A * | 11/1966 | Pewitt | 215/395 |
| 3,381,849 | A * | 5/1968 | Gosta | 206/520 |
| 4,013,293 | A * | 3/1977 | Hess et al. | 273/239 |
| 5,213,211 | A * | 5/1993 | Umiker | 206/392 |
| 5,273,182 | A * | 12/1993 | Laybourne | 220/740 |
| 7,325,803 | B1 * | 2/2008 | Miranda | 273/108.5 |
| 7,325,807 | B1 * | 2/2008 | Eason | 273/342 |
| 7,546,932 | B2 * | 6/2009 | Smith et al. | 220/675 |
| 8,272,506 | B1 * | 9/2012 | Flannery et al. | 206/217 |
| 8,282,457 | B1 * | 10/2012 | Edwards | 463/7 |
| 2002/0134701 | A1 * | 9/2002 | Olsthoorn | 206/503 |
| 2004/0188942 | A1 * | 9/2004 | Trokan | 273/342 |
| 2005/0029747 | A1 * | 2/2005 | Grayson | 273/342 |
| 2006/0000277 | A1 * | 1/2006 | Pietrorazio | 73/293 |
| 2006/0032776 | A1 * | 2/2006 | Klein et al. | 206/520 |
| 2007/0107460 | A1 * | 5/2007 | Webb et al. | 62/457.3 |
| 2010/0154683 | A1 * | 6/2010 | Royka | 108/28 |
| 2010/0170838 | A1 * | 7/2010 | Falcone | 210/222 |

* cited by examiner

*Primary Examiner* — Nini Legesse

(74) *Attorney, Agent, or Firm* — James M. Smedley LLC; James Michael Smedley, Esq.

(57) ABSTRACT

The present invention generally relates to drinking games and apparatuses for the use therewith. Specifically, this invention relates to an improved drinking game component and cup alignment apparatus for use with various drinking games. The drinking game cup or attachment and cup alignment apparatus may be designed in such a manner as to allow for simplified, accurate and reliable positioning of one or more drinking cups on a playing surface.

20 Claims, 32 Drawing Sheets

DRINKING GAME CUP OR ATTACHMENT WITH MAGNETIC ALIGNMENT PAD

CROSS REFERENCE TO RELATED APPLICATIONS

This application claims the benefit of U.S. Provisional Patent Application No. 61/564,282 Filed Nov. 28, 2011, the entire disclosure of which is incorporated herein by reference.

FIELD OF THE INVENTION

The present invention generally relates to drinking games and apparatuses for the use therewith. Specifically, this invention relates to an improved drinking game component and cup alignment apparatus for use with various drinking games. The drinking game cup or attachment and cup alignment apparatus may be designed in such a manner as to allow for simplified, accurate and reliable positioning of one or more drinking cups on a playing surface.

BACKGROUND OF THE INVENTION

In drinking games, for example "Beer Pong", players are required to position or place cups in specific predetermined arrangements. Such arrangements are commonly referred to as "racks". With existing cups, the consistency, precision, and overall quality of racks tends to vary widely between games and players. However, game rules typically require well aligned and snugly fit arrangements or racks. As with other sports, consistent court or playing field setup is very important for fair, reliable, and legitimate competition or game play to occur. Additionally, existing cups and playing surfaces lack any means for securing a cup to the playing surface. Without such a securing means, current cups and playing surfaces cannot ensure precise racks or prevent accidental spilling from the cups.

Therefore, there is a need in the art for an apparatus that simplifies the process of accurately and precisely positioning drinking game cups and preventing accidental spills. These and other features and advantages of the present invention will be explained and will become obvious to one skilled in the art through the summary of the invention that follows.

SUMMARY OF THE INVENTION

The present invention provides a drinking game component and alignment apparatus. The drinking game component herein described, along with the alignment apparatus allows for the accurate and precise positioning of a plurality of drinking game components for the use in drinking games.

According to an embodiment of the present invention, a drinking game component, the drinking game component comprising: a cup, and an alignment part formed in a base of the cup, wherein the alignment part is configured to mate with a playing surface in order to align the cup for game play.

According to an embodiment of the present invention, the alignment part is integrally formed in the base of the cup.

According to an embodiment of the present invention, the cup is a beverage container.

According to an embodiment of the present invention, the cup is configured to receive a standard beverage container.

According to an embodiment of the present invention, the alignment part is magnetic.

According to an embodiment of the present invention, the cup includes a stacking groove integrally formed in the base of the cup.

According to an embodiment of the present invention, the playing surface is an alignment pad with at least one alignment part mating component configured to engage with the alignment part.

According to an embodiment of the present invention, the alignment pad is used to align one or more drinking game components in relation to one another.

According to an embodiment of the present invention, the alignment part mating component is magnetic.

According to an embodiment of the present invention, the system of claim 8, the alignment pad can be manipulated to form a storage receptacle for the one or more drinking game components.

DETAILED SPECIFICATION

The present invention generally relates to drinking games and apparatuses for the use therewith. Specifically, this invention relates to an improved drinking game component and cup alignment apparatus for use with various drinking games. The drinking game cup or attachment and cup alignment apparatus may be designed in such a manner as to allow for simplified, accurate and reliable positioning of one or more drinking cups on a playing surface.

Turning now to FIGS. 1, 2, 3, 4A, 4B, 4C, 4D, 4E, 4F, 5, 6, and 7, a preferred embodiment of a drinking game cup or attachment with a magnetic alignment pad is shown. In the preferred embodiment of the invention, the drinking game cup or attachment with a magnetic alignment pad is configured in an efficient design. One of ordinary skill in the art would appreciate that there are many suitable design and configurations for the present invention, and embodiments of the present invention are contemplated for use with any such design or configuration.

Figure 1:
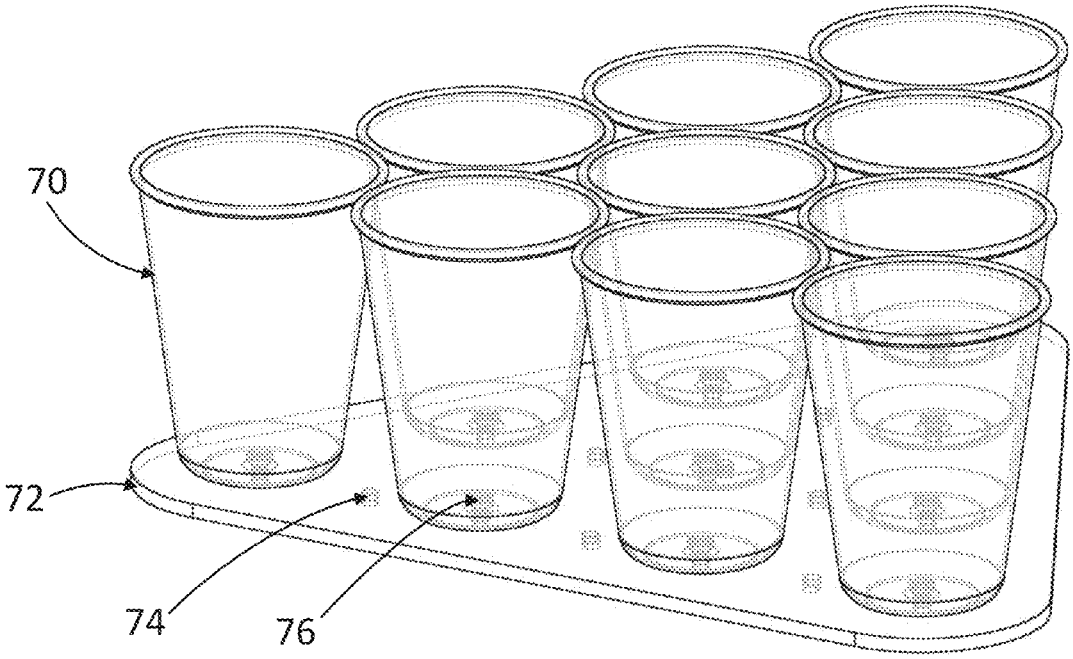
FIG. 1 is a 3-D perspective view of the first embodiment.
Figure 2:
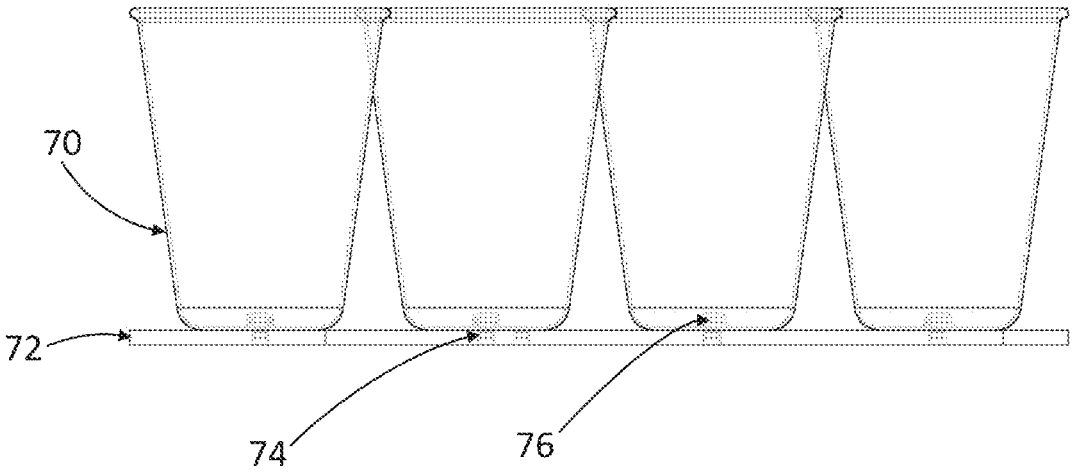
FIG. 2 is a side view of the first embodiment.
Figure 3:
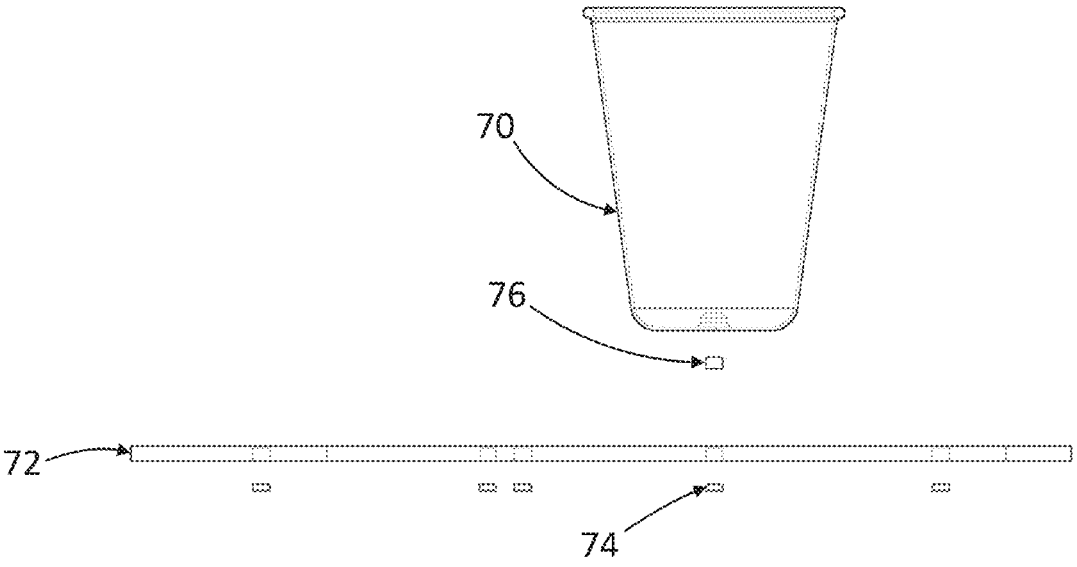
FIG. 3 is an exploded view of the first embodiment from the side.
Figure 4A:
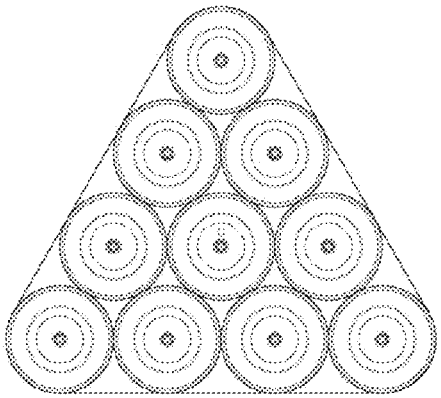
FIG. 4A is a top view of one possible high quality arrangement, or rack, using ten cups.
Figure 4B:
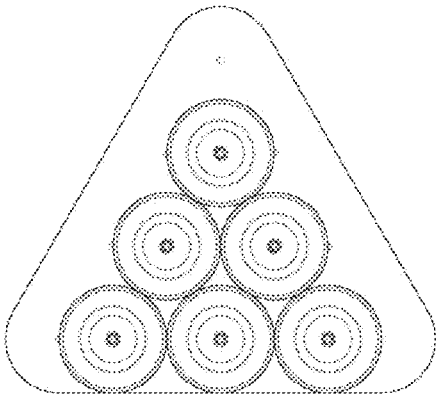
FIG. 4B is a top view of one possible high quality arrangement, or rack, using six cups.
Figure 4C:
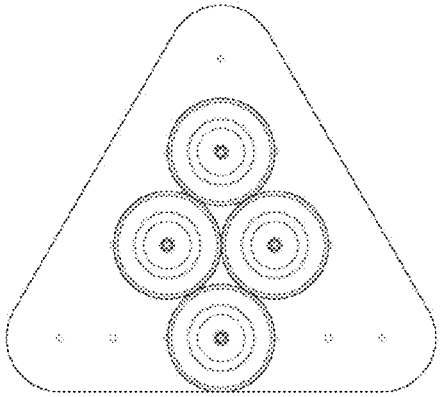
FIG. 4C is a top view of one possible high quality arrangement, or rack, using four cups.
Figure 4D:
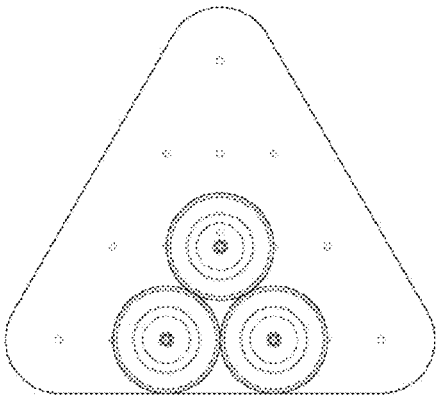
FIG. 4D is a top view of one possible high quality arrangement, or rack, using three cups.
Figure 4E:
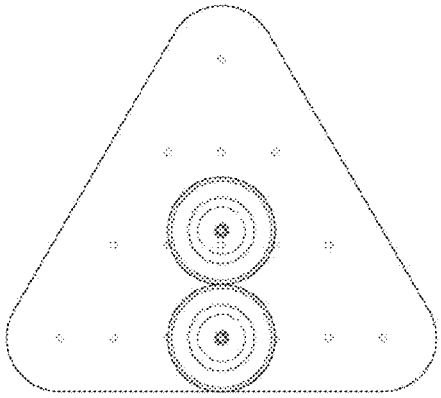
FIG. 4E is a top view of one possible high quality arrangement, or rack, using two cups.
Figure 4F:
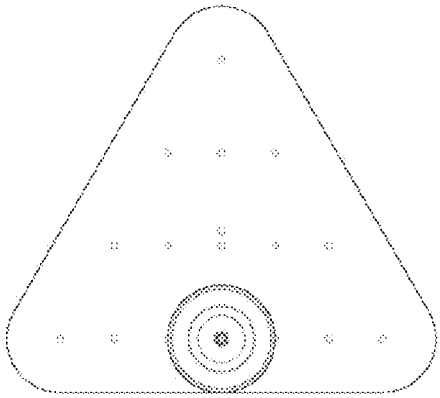
FIG. 4F is a top view of one possible high quality arrangement, or rack, using one cup.

Turning now to FIG. 1 an isometric view in accordance with an embodiment of the present invention is shown. A mat, base plate, table, or pad 72 is placed below a cup 70. In a preferred embodiment there are ten separate cups 70. In alternate embodiments there may be more than ten cups or there may be less. Inside the cup 70 is a pin, dowel, or alignment part 76. Inside the pad 72 is an alignment part mating component 74. In a preferred embodiment, the alignment part mating component is a magnet. In alternate embodiments, the alignment part mating component 74 may be replaced with any suitable fastening means, including but not limited to, a friction fit component or a pin. This embodiment is illustrated from different perspectives in FIG. 2 and FIG. 3. One of ordinary skill in the art would appreciate that the drinking game cup and magnetic alignment pad would be functional with a variety of components, and embodiments of the present invention are contemplated for use with any such component.

Figure 5:
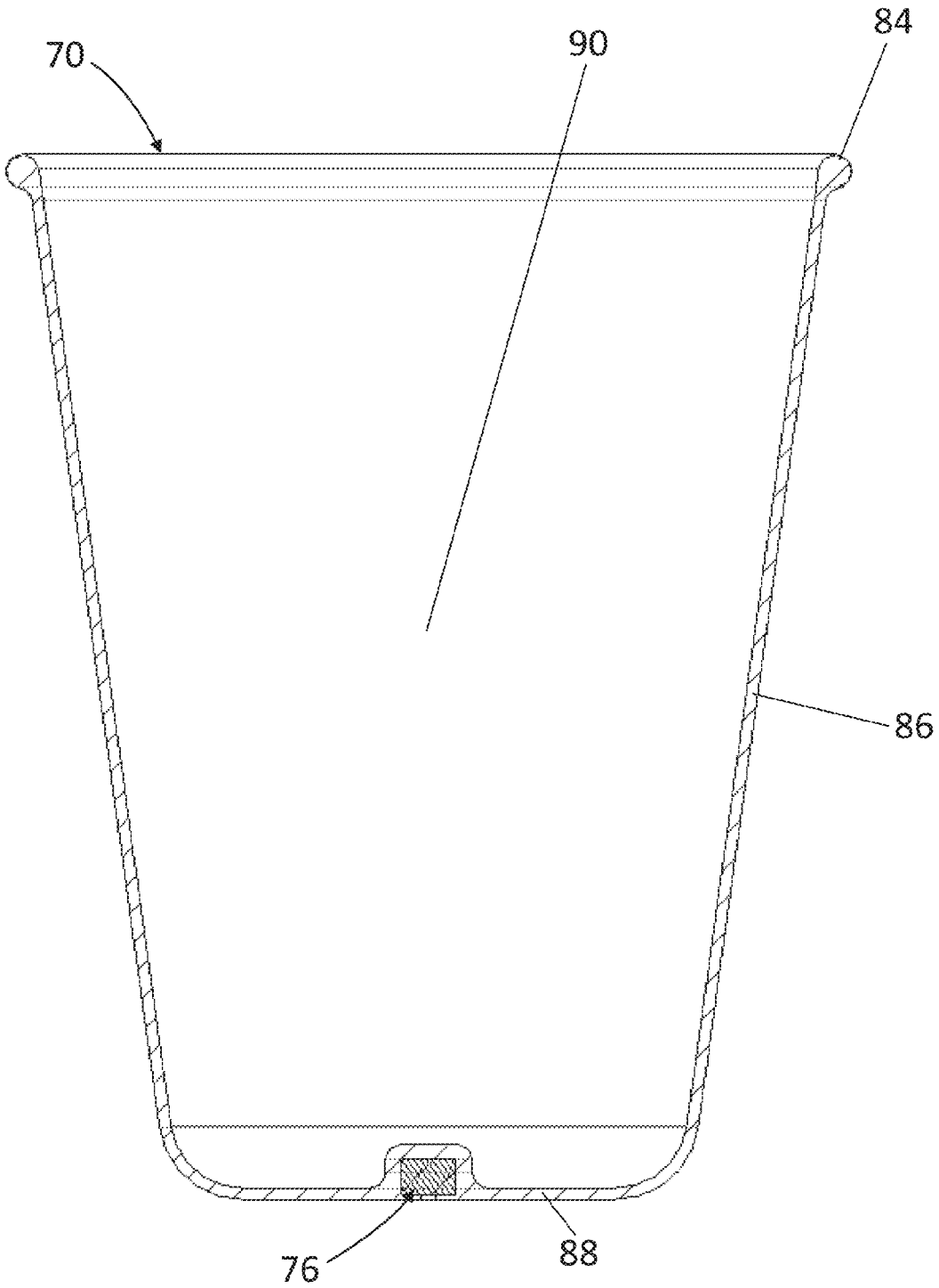
FIG. 5 is a cross sectional side view of the cup in the first embodiment.

Turning now to FIG. 5 a cross section view from the side of the cup 70 in accordance with an embodiment of the present invention is shown. At the top of the cup 70 is a substantially circular ring or rim 84. The rim 84 of this embodiment has a uniform circular cross section. In other embodiments the rim 84, or the rim 84 cross-section, may be a different size or shape.

According to an embodiment of the present invention, the bottom of the cup 70 is a base 88. The base 88 of the preferred embodiment is substantially circular. In other embodiments, the base 88 could be a different shape or size such as square, diamond, hexagon, or interlocking or interconnecting shapes. One of ordinary skill in the art would appreciate that the cup or similar vessel could be made in a variety of shapes, and embodiments of the present invention are contemplated for use with a cup of any shape.

According to an embodiment of the present invention, connecting the base 88 of the cup 70 to the rim 84 is a wall 86. In this embodiment, the wall 86 is substantially straight. In other alternate embodiments the wall 86 may have unique curvature in order to join the base 88 to the rim 84. Together, the rim 84, wall 86, and base 88 surround a holding space or a containment space 90. One of ordinary skill in the art would appreciate that the cup may formed in a variety of designs, and embodiments of the present invention are contemplated for use with any such design.

According to an embodiment of the present invention, the cup 70 and the pad 72 is made of plastic. In a preferred embodiment, the plastic may be polypropylene or any similar plastic. In alternate embodiments, other materials that are suitable for use include wood or a non-magnetic metal. One of ordinary skill in the art would appreciate that there are many materials the cup could be made of, and embodiments of the present invention are contemplated for use with any such material.

According to an embodiment of the present invention, the cup 70 may be manufactured using an injection molding process. In this embodiment the alignment part 76 is insert molded or over molded into the center of the base 88 of the cup 70. Therefore the alignment part 76 is securely fastened and joined to the cup 70. One of ordinary skill in the art would appreciate that a variety of methods could be used to manufacture the cup, and embodiments of the present invention are contemplated for use with any such manufacturing method.

According to an embodiment of the present invention, the alignment part 76 is magnetic. In a preferred embodiment the alignment part 76 is made of iron, nickel, cobalt or some other ferromagnetic or ferrimagnetic material. In alternate embodiments the alignment part 76 may itself actually be a permanent magnet. If this is the case, the alignment part 76 will be assembled into the cup 70 in an orientation such that its magnetic poles are opposite to the magnetic poles of the magnet used for the alignment part mating component 74 which are assembled into the pad 72. In another alternate embodiment, the alignment part 76 could be a permanent magnet. In this case the alignment part mating component 74 could simply be a ferromagnetic or ferromagnetic material and would not necessarily need to be a permanent magnet itself. In alternate embodiments, the alignment part 76 might be a nonmagnetic friction fit or similar structure. One of ordinary skill in the art would appreciate that an alignment part 76 could be functional in a variety of forms, and embodiments of the present invention are contemplated for use with any such forms.

Figure 6:
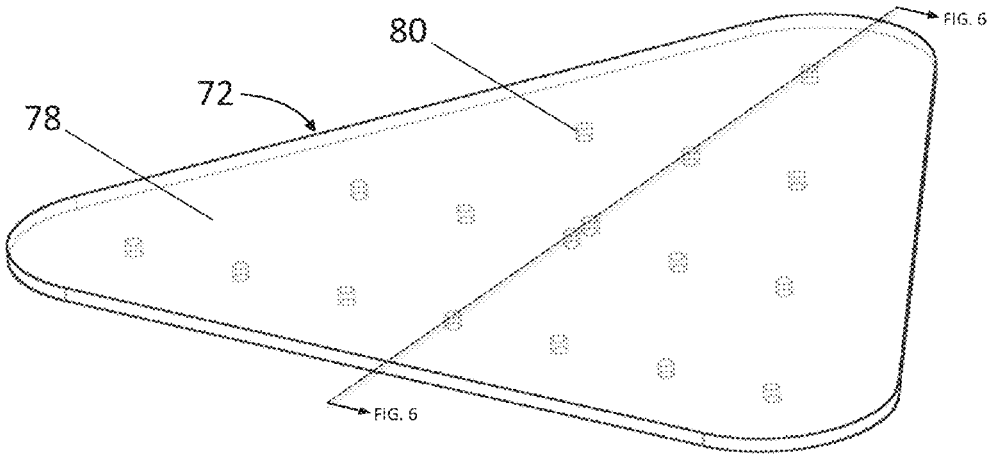
FIG. 6 is a 3-D perspective view of the pad in the first embodiment.

Turning now to FIG. 6 an isometric view of the pad 72 in accordance with embodiment of present invention is shown. At the top of the pad 72 is a pad top surface 78. In a preferred embodiment, the top surface 78 is flat and smooth. Cut into the bottom of the pad 72 is a pocket or alignment part mating component hole 80. In the preferred embodiment, the pad 72 has seventeen strategically located alignment part mating component holes 80. In alternate embodiments there may be more than seventeen alignment part mating component holes 80, or there may be less. According to an embodiment of the present invention, the distance between most of the alignment part mating component holes 80 is equal to the outer diameter of the rim 84 of the cup 70. The reason for this will be explained in the Operation section of this document. In alternative embodiments, the distance between the alignment part mating component holes 80 may vary. One of ordinary skill in the art would appreciate that the distances could vary, and embodiments of the present invention are contemplated for use with any distance between one or more alignment part mating component holes 80.

Figure 7:
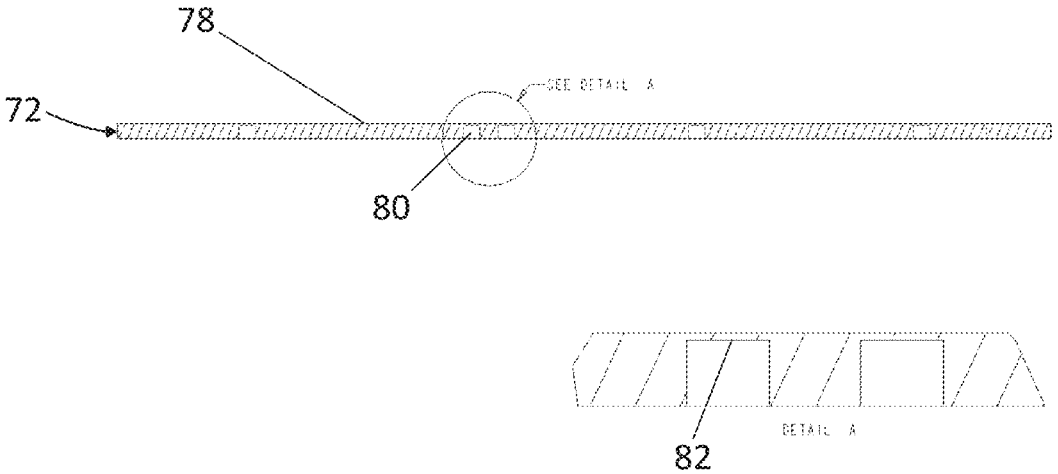
FIG. 7 is a cross sectional side view of the pad in the first embodiment.

Turning now to FIG. 7 a cross-sectional side view of the pad 72 in accordance with an embodiment of the present invention is shown. At the bottom of the alignment part mating component hole 80 is a bottom surface or alignment part mating component hole bottom 82. In this embodiment there is a relatively small distance between the alignment part mating component hole bottom 82 and the pad top surface 78. The reason for this will also be explained in the Operation section.

According to an embodiment of the present invention, there is one alignment part mating component 74 for each alignment part mating component hole 80. In preferred embodiment the alignment part mating components 74 are pressed into each of the alignment part mating component holes 80. In this embodiment the size of the alignment part mating component hole 80 is slightly smaller than the size of the alignment part mating component 74 in order to obtain a press fit. Therefore the alignment part mating component 74 are securely fastened and joined to the pad 72.

According to an embodiment of the present invention, the alignment part mating component 74 has a cylindrical shape. In this embodiment the alignment part 76 also has a cylindrical shape. In this embodiment the outer diameter of the alignment part 76 and the outer diameter of the alignment part mating component 74 are equal and the same. In other embodiments, the alignment part 76 and the alignment part mating component 74 may be different sizes or shapes such as a square or rectangle for example.

Operation—First Embodiment—FIGS. 1-7

In drinking games, for example Beer Pong, players are required to position or place cups in specific predetermined arrangements. Such arrangements are commonly referred to as "racks". With existing cups, the consistency, precision, and overall quality of racks tends to vary widely between games and players. However, game rules typically require well aligned and snugly fit arrangements or racks. As with other sports, consistent court or playing field setup is important for fair, reliable, and legitimate competition to occur.

Users of this embodiment can achieve an improved alignment, rack, or fit with adjacent cups. With existing cups, the user will typically utilize the existing cup's rim as a racking guide. However, the rim of existing cups only provides users with a single tangential point of contact to assist in alignment and spacing. Furthermore, existing cups are not attached to the grounds on which they are placed, they are free to move out of place and often do so as the user attempts to move adjacent cups closer together.

This embodiment provides the user with strategically located magnetic fields which can be used to assist the user in the racking and arrangement process. As the user moves a cup 70 into its approximate intended position, the alignment part 76 within the cup will experience a magnetic force from the alignment part mating component 74 inside the pad 72. This magnetic force will pull the cup 70 into the proper position.

According to an embodiment of the present invention, by applying a magnetic force to the alignment part 76 within the cup 70, the cup has less free range of motion, ensuring that the user can achieve higher quality cup arrangements, do so more easily, and do so in less time. This embodiment also allows users to more easily align racks or cup arrangements with lines on the playing surface or other guides which may be in place during game play. As an illustrative example, FIGS. 4A, 4B, 4C, 4D, 4E, and 4F demonstrate the patterns of high quality racks which can be achieved in this embodiment using ten, six, four, three, two, and one cups 70 respectively. These figures also show why the alignment part mating component holes 80 in the pad 72 in this embodiment are spaced at a distance equal to the outer diameter of the rim 84 on the cup 70. Because of this spacing of the alignment part mating component holes 80, the cups 70 are held snugly and tangentially together in each of the various racks.

Additionally, existing cups are often moved unintentionally and undesirably by impacts from a ping pong ball or accidentally by the user's hands. In this embodiment the magnetic force which is applied to the alignment part 76 helps to keep the cup 70 in its proper and desired position during and throughout game play. Not only does this assist in maintaining the quality of the rack, it will also help to prevent accidentally spilling the contents of the cup 70.

In any embodiment where the alignment part mating component 74 is a magnet, a number of variables can be modified in such an embodiment to increase or decrease the magnetic force between the alignment part mating component 74 and the alignment part 76. One of these variables is the distance between the two parts when the cup 70 is in its desired position. This is why the distance between the alignment part mating component hole bottom 82 and the pad top surface 78 may be relatively small. By reducing the distance between the alignment part mating component 74 and the alignment part 76, one could reduce the cost of producing this embodiment by using a smaller or less powerful magnet as the alignment part mating component 74. Furthermore, one can adjust the design of this embodiment so that a specifically preferred amount of magnetic force is applied to the alignment part 76.

In this embodiment, the exposed portion of the rim 84 follows a smooth and continuous circular curvature and has a uniform circular cross section. This provides improved consistency, reliability, and predictability for users during game play. This is particularly important for drinking games such as beer pong where the impact and resulting reaction of balls (typically ping pong balls) off of the rim 84 is critical to the outcome of the game. In addition, the rim 84 of the cup 70 provides an opening for liquids or other objects to enter the containment space 90.

The geometry of the cup 70 and the pad 72 are such that this embodiment may be more easily mass produced using injection molding techniques. Furthermore, the geometry of the cup 70 in this embodiment is such that some traditional elements of game play may be maintained.

Figure 8:
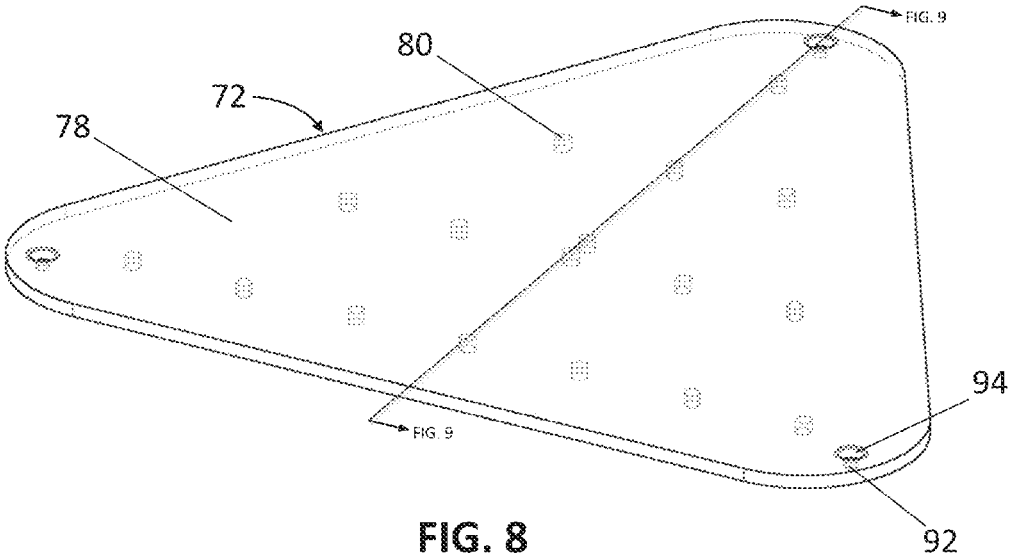
FIG. 8 is a 3-D perspective view of the pad in an alternative embodiment.
Figure 9:
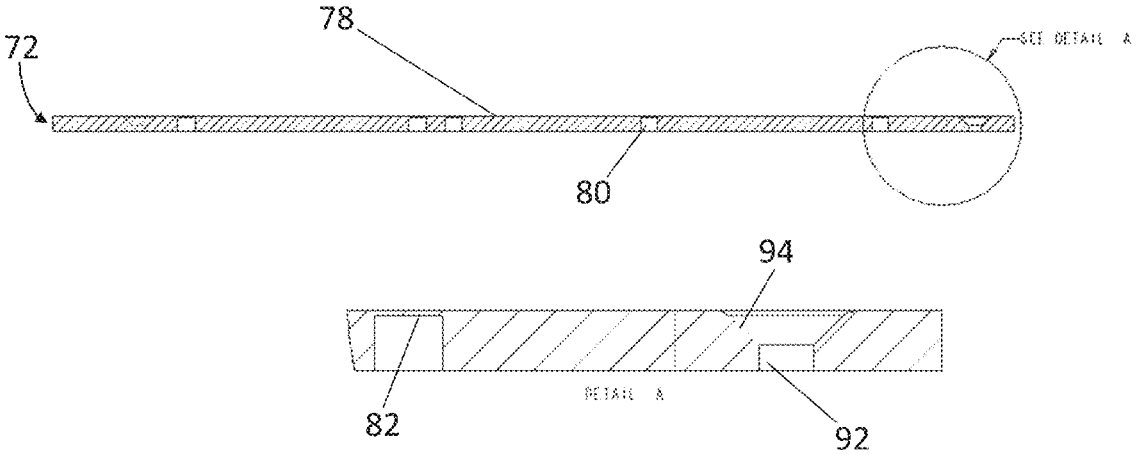
FIG. 9 is a cross sectional side view of the pad in an alternative embodiment.

Additional Embodiment—FIGS. 8-9

One additional embodiment of present invention is illustrated in FIG. 8 and FIG. 9.

Turning now to FIG. 8, an isometric view of the pad 72 in accordance with an embodiment of the present invention. In the preferred embodiment, there is a through hole, screw hole, or mounting hole 92 strategically located through the pad top surface 78 of the pad 72. Around the top edge of the mounting hole 92 is a lead in, countersink, or mounting hole chamfer 94. In this embodiment there are three mounting holes 92 each with a mounting hole chamfer 94. In other embodiments there may be more than 3 mounting holes 92 or there may be less.

According to an embodiment of the present invention, the mounting holes 92 may be shaped like slots to make it easier for the user to adjust the position of the pad 72.

According to an embodiment of the present invention, the mounting holes 92 will allow the user to securely attach the pad 72 to a surface using screws, bolts, nails, or the like. One of the benefits of mounting the pad 72 may be that it is more difficult to lift off of the surface it is mounted to. For example, when the user lifts a cup 70 off of the pad 72, if the magnetic force between the alignment part 76 and the alignment part mating component 74 is greater than the weight of the pad 72 and any other remaining cups 70 which have been placed on the pad 72, then the mounted pad 72 will remain on the surface it is attached to, rather than the entire pad 72 being lifted due to the magnetic force between the alignment part 76 and the alignment part mating component 74. Additionally, users can ensure that the pad 72 remains fixed and aligned in a specific direction and at a specific place on the surface it is attached to.

Additional Embodiment—FIGS. 10-13

One additional embodiment of present invention is illustrated in is illustrated in FIGS. 10, 11, 12, and 13.

Figure 10:
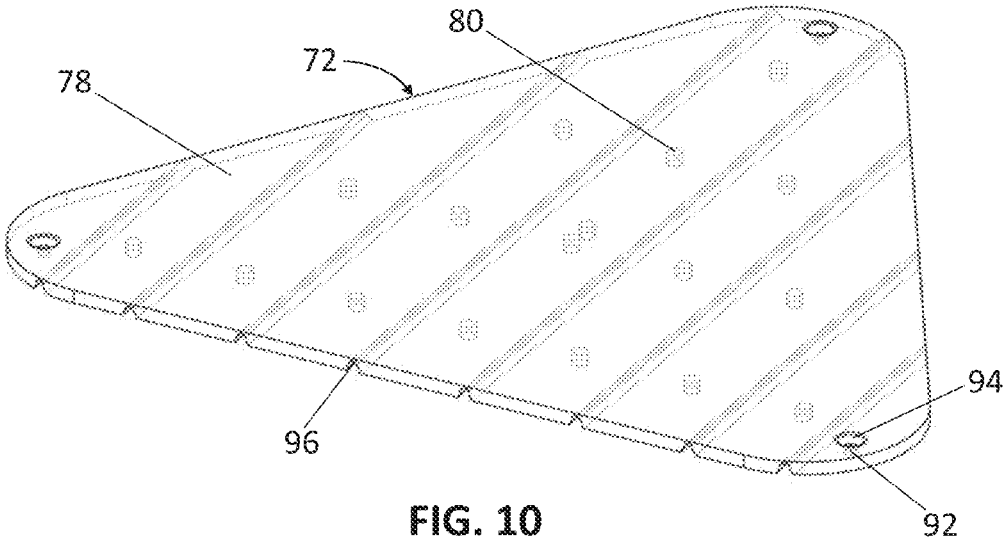
FIG. 10 is a 3-D perspective view of the pad in an alternative embodiment.
Figure 11:
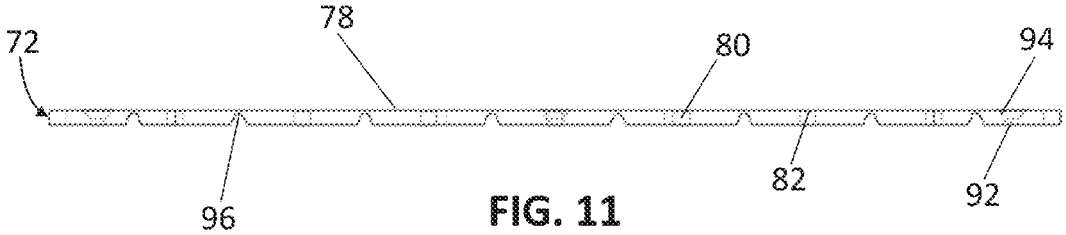
FIG. 11 is a side view of the pad in an alternative embodiment.

Turning now to FIG. 10, an isometric view of the pad 72 in accordance with an embodiment of the present invention. According to an embodiment of the present invention, there is a groove or folding notch 96 running the length of the pad 72. In a preferred embodiment the folding notch 96 has a V shape, in other embodiments the shape of the folding notch 96 may vary. In the preferred embodiment, there are eight folding notches 96. In other embodiments there may be more than eight folding notches 96 or there may be less.

Figure 12:
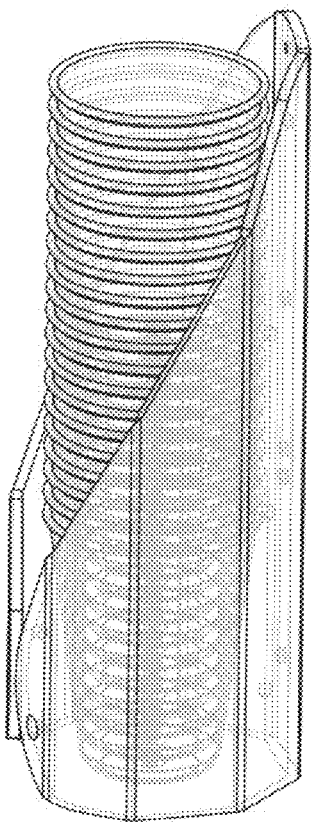
FIG. 12 is a 3-D perspective view of an alternative embodiment with the pad in a folded state.
Figure 13:
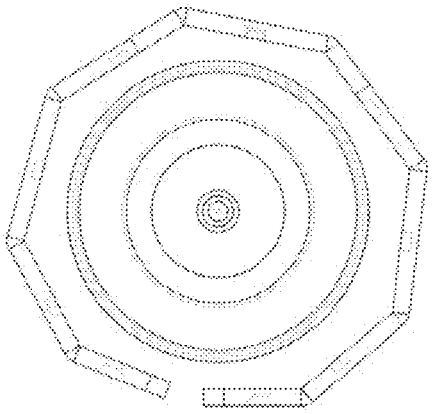
FIG. 13 is a top view of an alternative embodiment with the pad in a folded state.

Turning now to FIG. 12 and FIG. 13, an exemplary embodiment of the present invention showing the pad 72 in a rolled up state with a number of cups 70 stacked within. According to an embodiment of the present invention, the folding notch 96 allows users to fold or roll up the pad 72. This embodiment may be easier to transport and may consume less space during transportation or storage.

Figure 14:
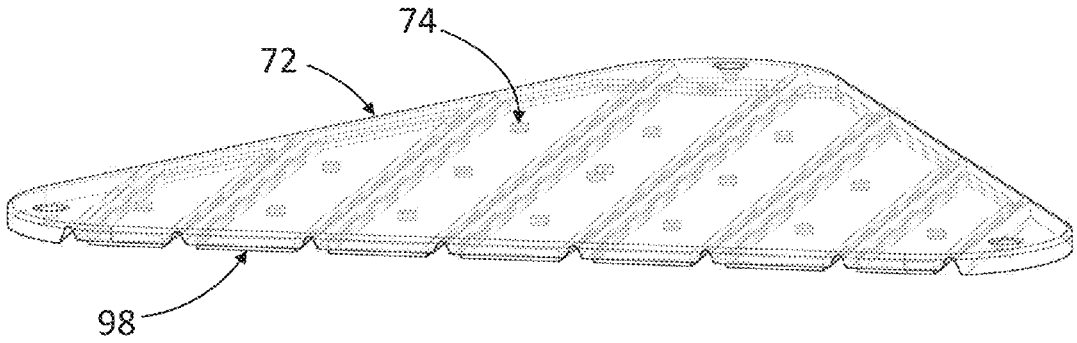
FIG. 14 is a 3-D perspective view of the pad in an alternative embodiment.
Figure 15:
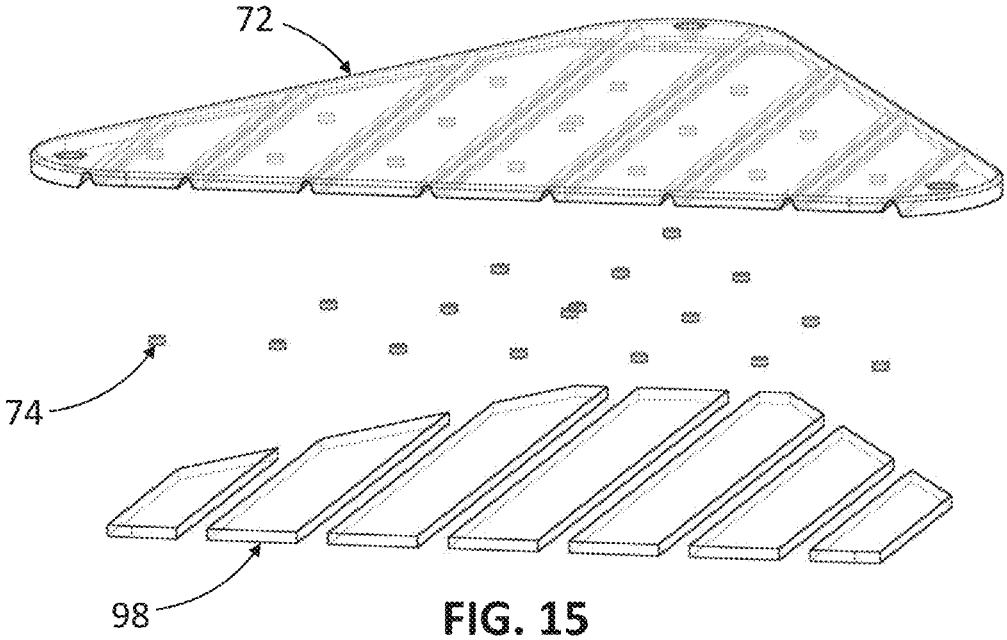
FIG. 15 is an exploded 3-D perspective view of the pad in an alternative embodiment.
Figure 16:
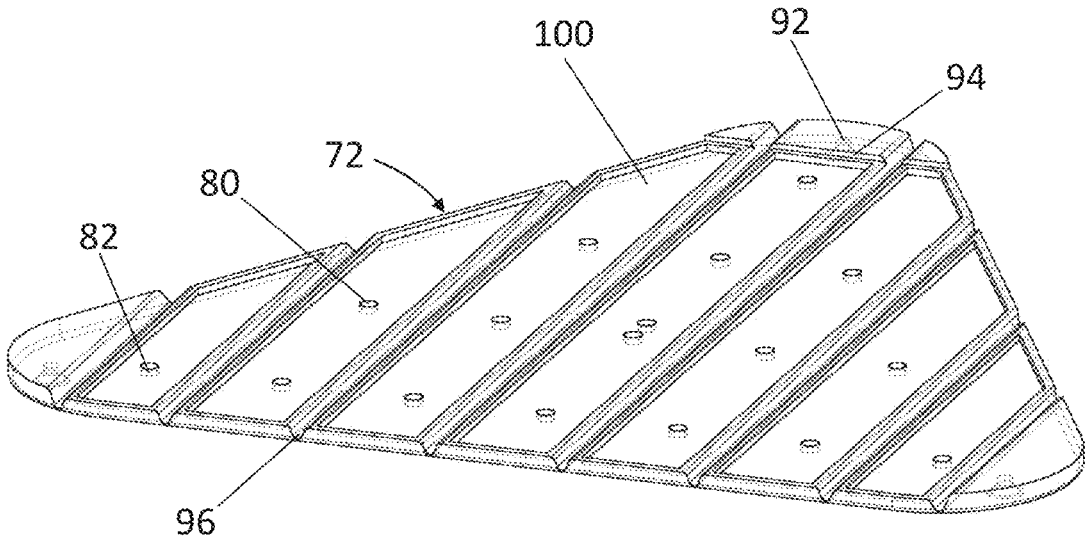
FIG. 16 is a 3-D perspective view showing the bottom of the pad in an alternative embodiment.

Additional Embodiment—FIGS. 14-16

One additional embodiment of present invention is illustrated in FIGS. 14, 15, and 16.

According to an embodiment of the present invention, there is a sealing part, grip part, or cap 98. The cap 98 assembles into a cutout, hole, or cap pocket 100 in the pad 72. In a preferred embodiment, the cap 98 could be press fit, attached using adhesive, secured by snap features, secured by additional fasteners, heat staked, or ultrasonically welded to the pad 72. In other embodiments the cap 98 may be a different size or shape. In the preferred embodiment there are seven cap pockets 100 and there is a cap 98 for each cap pocket 100. In alternate embodiments there may be more than seven cap pockets 100 or there may be less.

According to an embodiment of the present invention, the cap 98 may be made of any suitable material, including, but not limited to, rubber, plastic, wood, metal or any combination thereof.

According to an embodiment of the present invention, the cap 98 secures, retains, or captures the alignment part mating components 74 within the pad 72. This protects the alignment part mating components 74 from the external environment and prevents them from falling out of the alignment part mating component holes 80. In the preferred embodiment, the cap 98 may also improve the grip or traction between the pad 72 and the surface the pad 72 is placed on.

Figure 17:
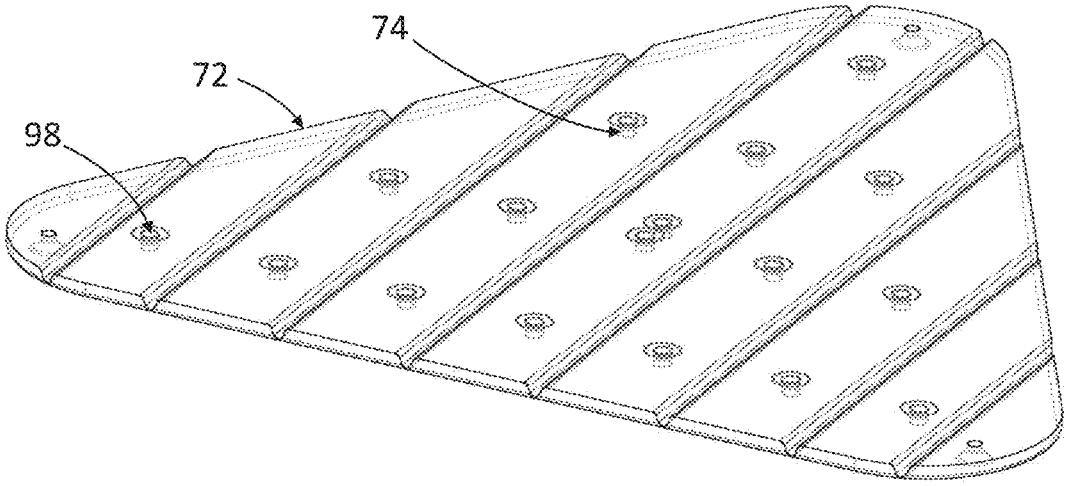
FIG. 17 is a 3-D perspective view of the pad in an alternative embodiment.
Figure 18:
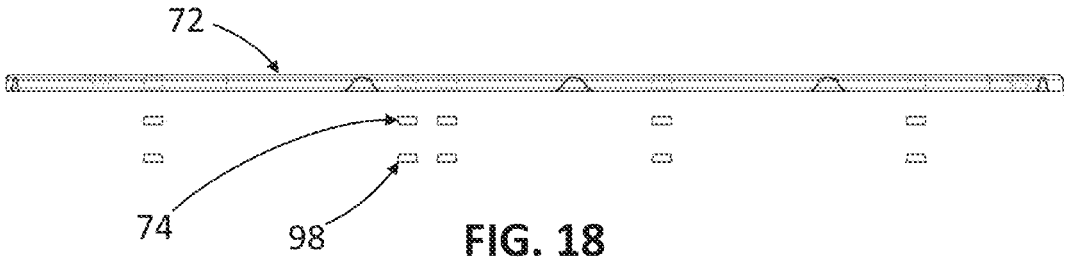
FIG. 18 is an exploded side view of the pad in an alternative embodiment.

Additional Embodiment—FIGS. 17-18

One additional embodiment of present invention is illustrated in FIG. 17 and FIG. 18.

Turning now to FIG. 17 and FIG. 18 another potential shape for the cap 98 is shown. In the preferred embodiment the cap 98 has a circular and slightly conical geometry which may lend itself better to a press fit type of attachment. In alternate embodiments, and as with the previous embodiments, the cap 98 could be attached using adhesive, secured by snap features, secured by additional fasteners, heat staked, or ultrasonically welded to the pad 72.

Figure 19:
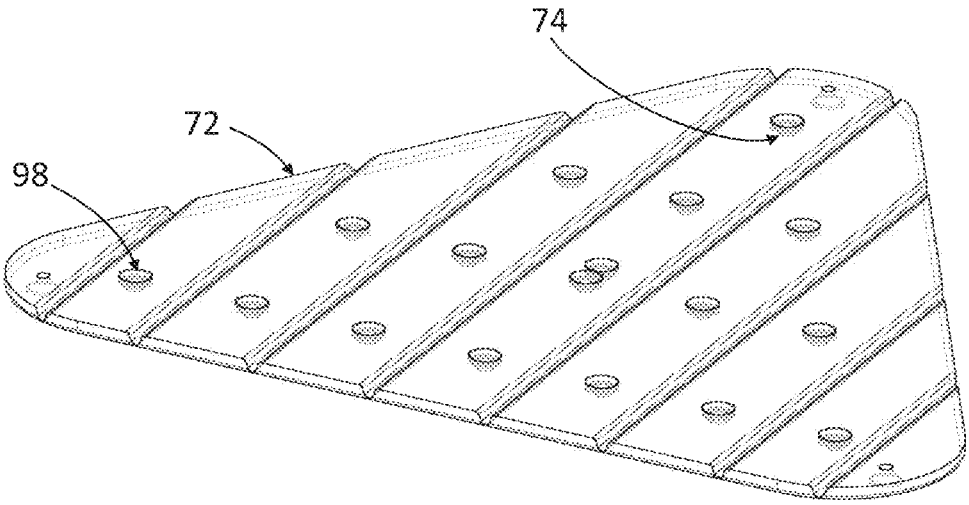
FIG. 19 is a 3-D perspective view of the pad in an alternative embodiment.
Figure 20:
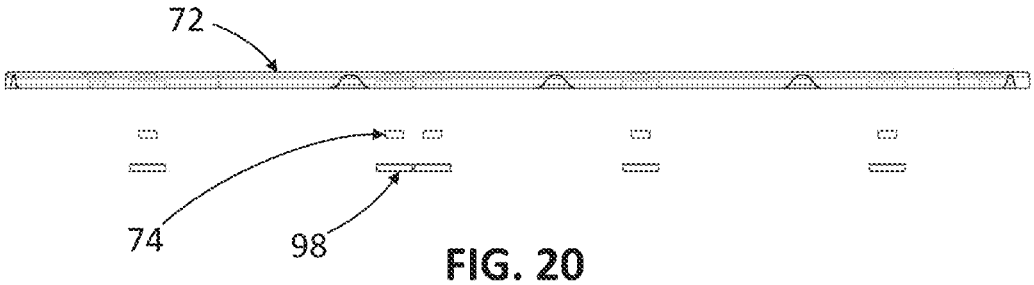
FIG. 20 is an exploded side view of the pad in an alternative embodiment.

Additional Embodiment—FIGS. 19-20

One additional embodiment of present invention is illustrated in FIG. 19 and FIG. 20.

Turning now to FIG. 19 and FIG. 20 another potential shape for the cap 98 is shown. In the preferred embodiment the cap 98 has a circular geometry and may lend itself better to an ultrasonic welding type of attachment. In alternate embodiments, and as with the previous embodiments, the cap 98 could be press fit, attached using adhesive, secured by snap features, secured by additional fasteners, or heat staked to the pad 72.

Additional Embodiment—FIGS. 21-24

One additional embodiment of present invention is illustrated in FIGS. 21, 22, 23, and 24.

Figure 21:
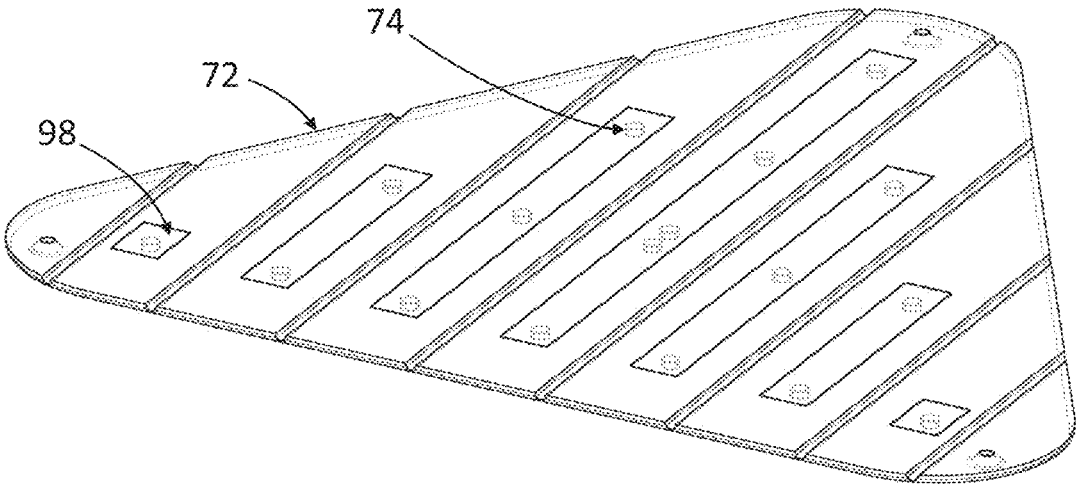
FIG. 21 is a 3-D perspective view of the pad in an alternative embodiment.
Figure 22:
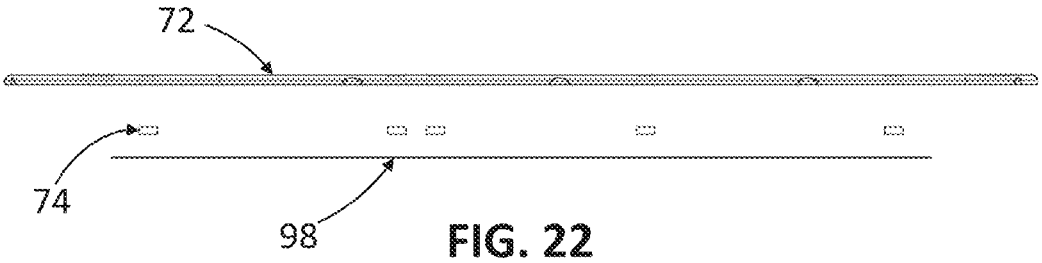
FIG. 22 is an exploded side view of the pad in an alternative embodiment.
Figure 23:
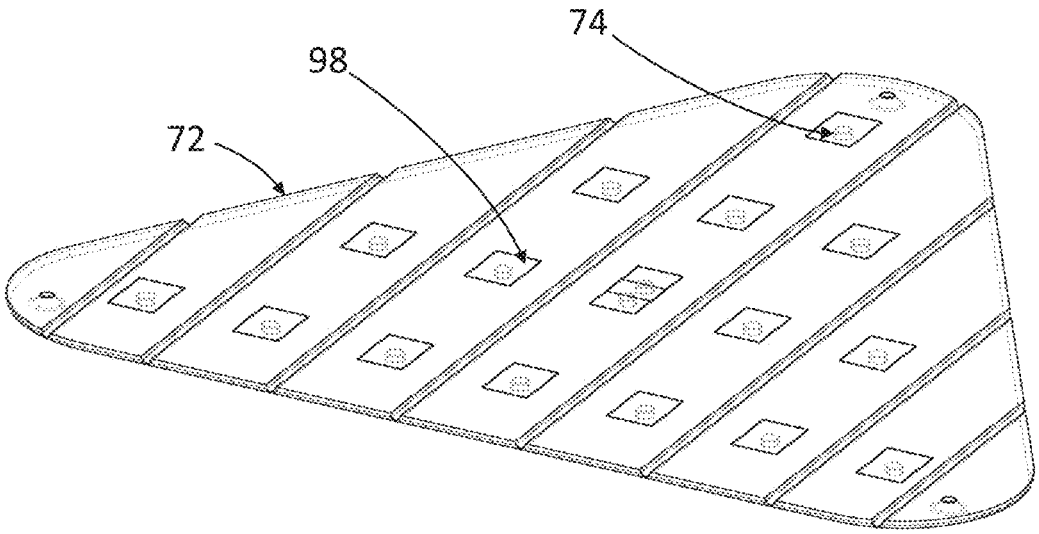
FIG. 23 is a 3-D perspective view of the pad in an alternative embodiment.
Figure 24:
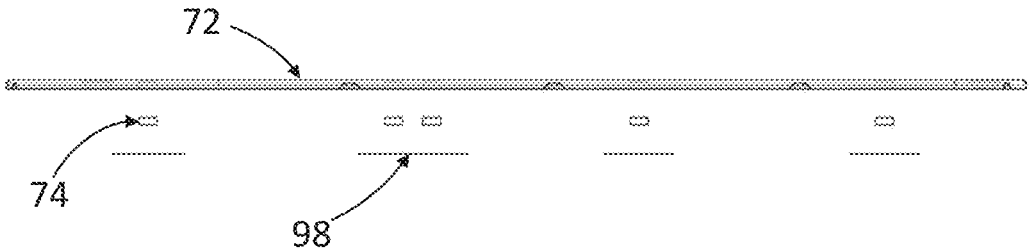
FIG. 24 is an exploded side view of the pad in an alternative embodiment.

Turning now to FIGS. 21, 22, 23, and 24 another potential shape for the cap 98 is shown. In this embodiment the cap 98 is a thin adhesive backed part. This embodiment may have the advantage of being lower profile or thinner. In one embodiment the pad 72 may have seven caps 98, as shown in FIG. 21. In an alternate embodiment the pad 72 may have one cap 98 for each alignment part mating component 74 or seventeen caps 98, as shown in FIG. 23. In further embodiments the number of caps 98, may be more less than seven or more or less than seventeen.

Figure 25:
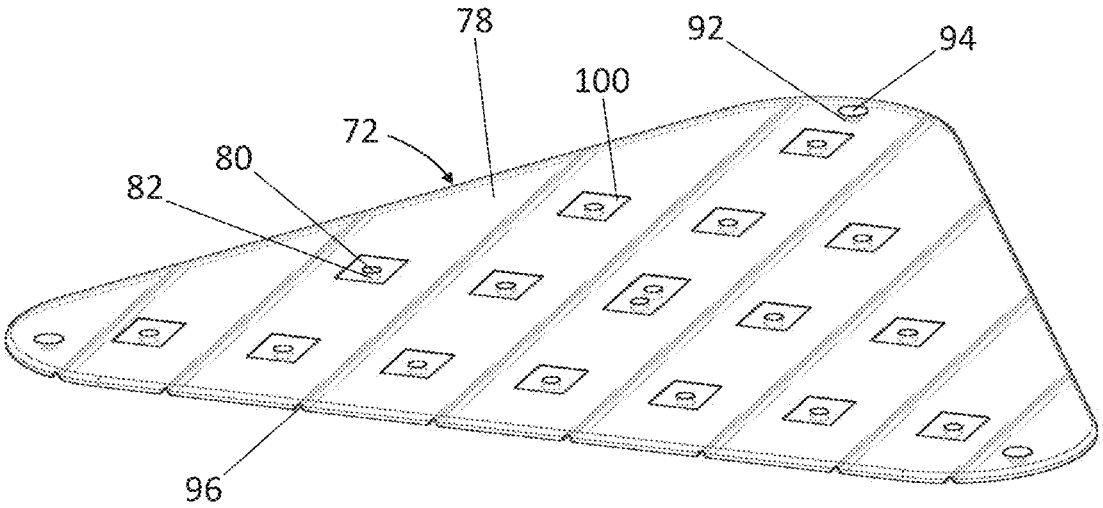
FIG. 25 is a 3-D perspective view of the pad in an alternative embodiment.
Figure 26:
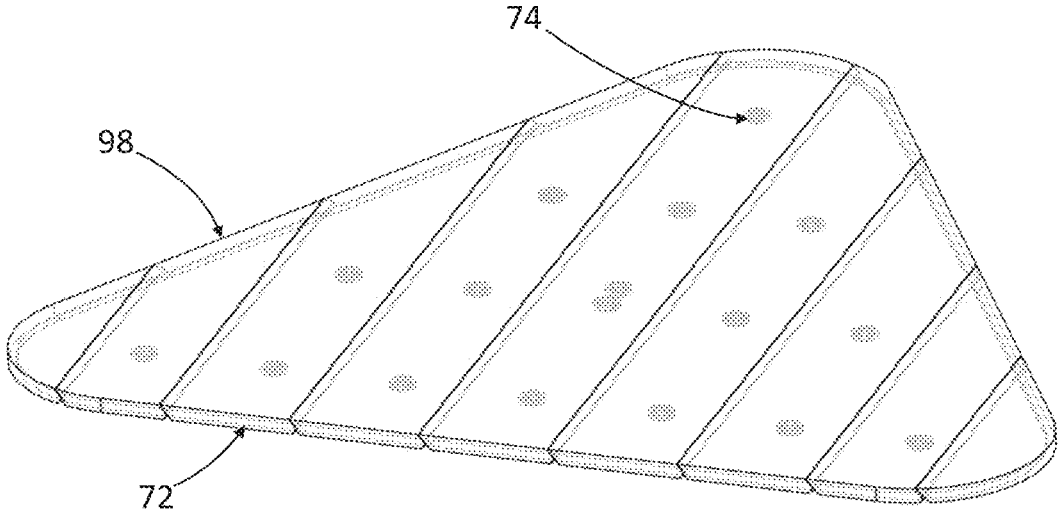
FIG. 26 is a 3-D perspective view of the pad in an alternative embodiment.
Figure 27:
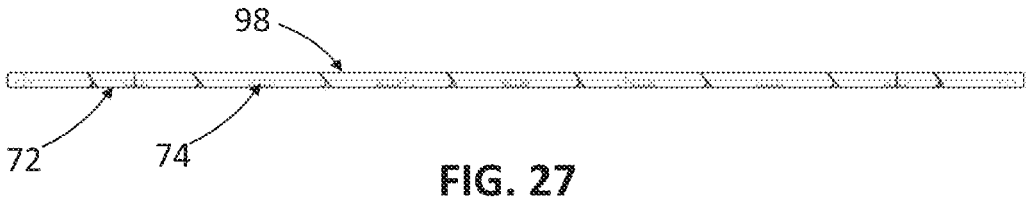
FIG. 27 is a side view of the pad in an alternative embodiment.
Figure 28:
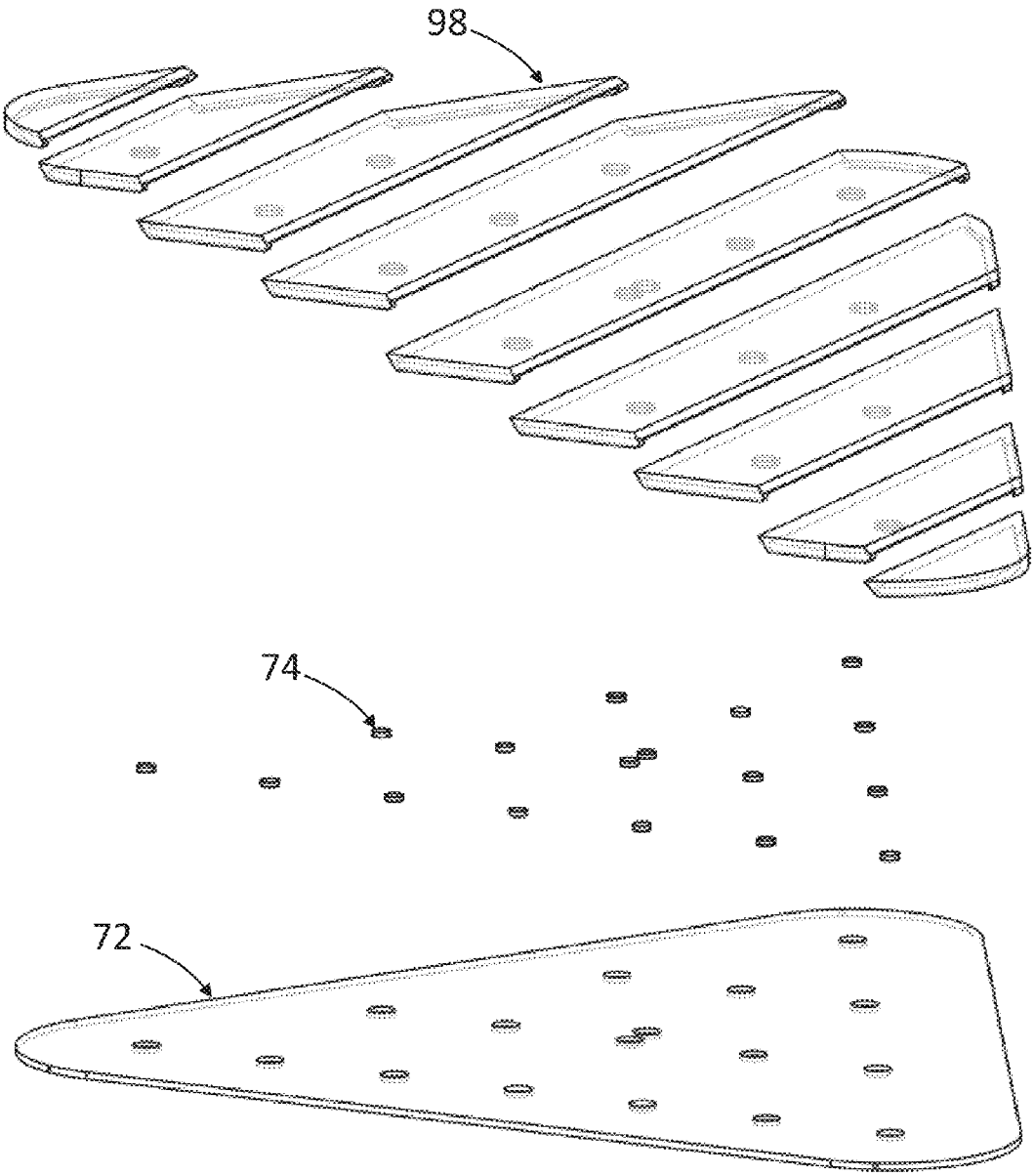
FIG. 28 is an exploded 3-D perspective view of the pad in an alternative embodiment.
Figure 29:
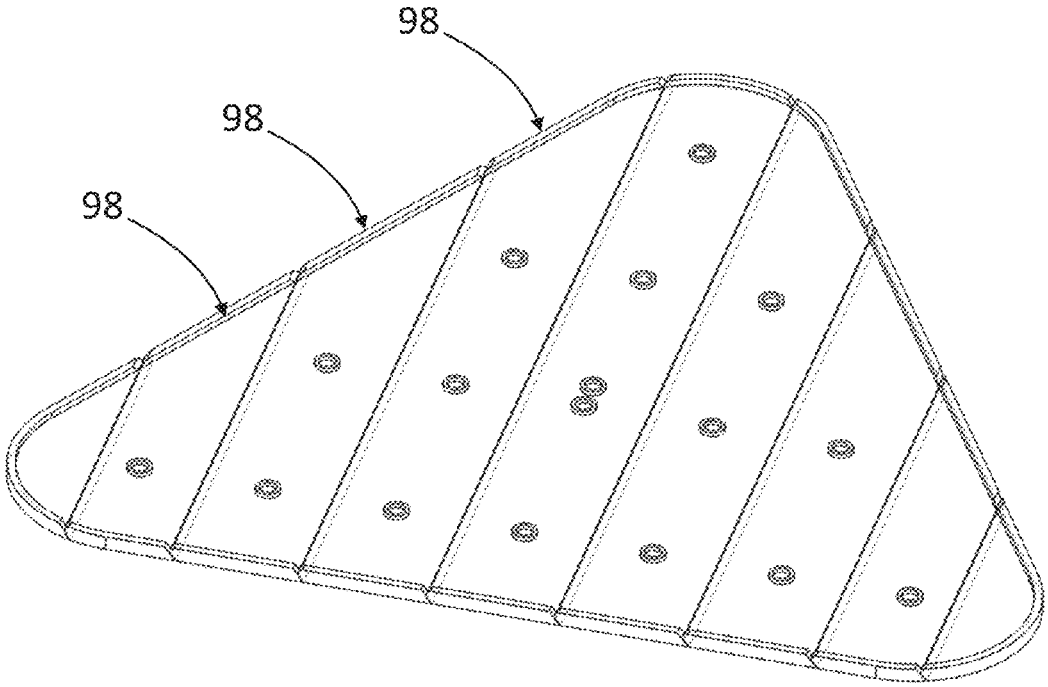
FIG. 29 is a 3-D perspective view showing the bottom of the caps in an alternative embodiment.
Figure 30:
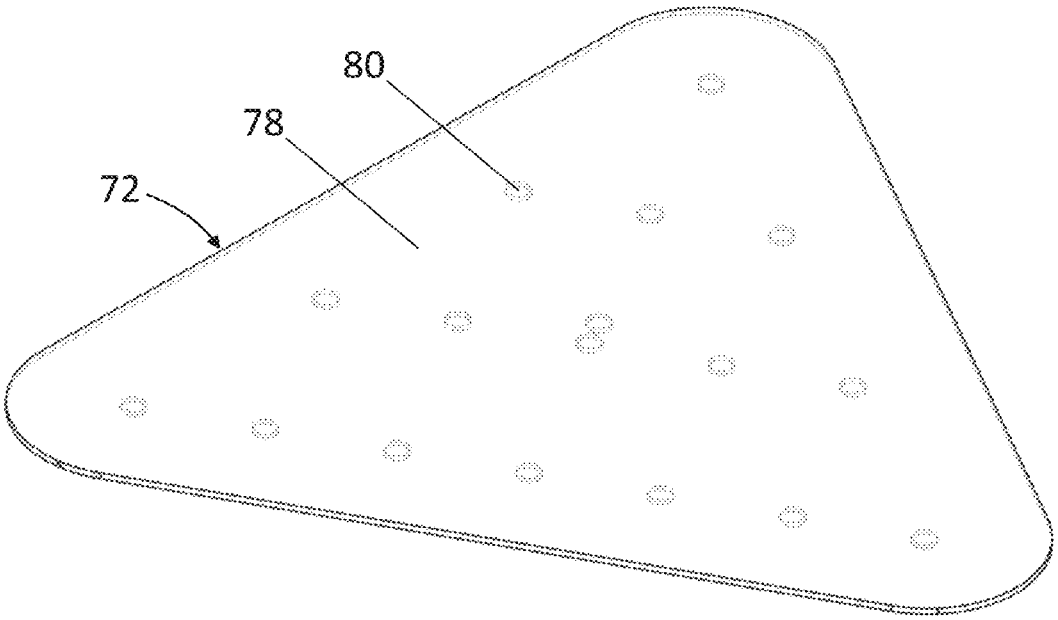
FIG. 30 is a 3-D perspective view of the pad in an alternative embodiment.

Additional Embodiment—FIG. 25

One additional embodiment of present invention is illustrated in FIG. 25.

Turning now to FIG. 25, an embodiment of present invention showing pad 72 where the cap pockets 100 are cut into the pad top surface 78. This embodiment may allow for a smaller distance between the alignment part mating component 74 in the pad 72 and the alignment part 76 in the cup 70. Also, because the caps 98 in this embodiment will be exposed to the user, the caps 98 may be used as decorative elements to enhance the aesthetics of the pad 72 or to enhance the user experience with the pad 72.

Additional Embodiment—FIG. 26-32

One additional embodiment of present invention is illustrated in FIGS. 26, 27, 28, 29, 30, 31, and 32.

Turning now to FIGS. 26, 27, 28, 29, and 30 showing a pad 72 that is made of rubber or some other flexible material. In this embodiment the caps 98 attach to the top surface 78 of the pad 72. The geometry of the caps 98 in this embodiment is such that the pad 72 may be folded or rolled up. Therefore this embodiment may be easier to transport and may consume less space during transportation or storage.

Figure 31:
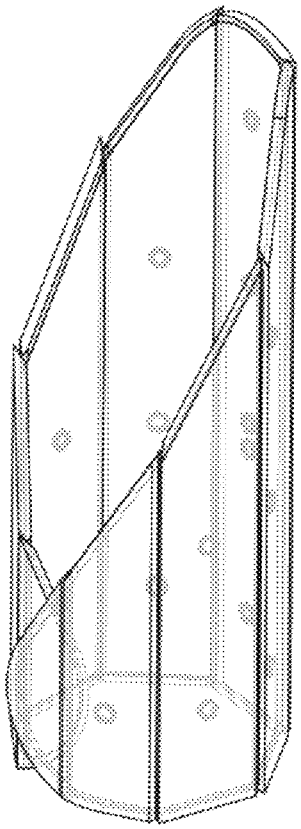
FIG. 31 is a 3-D perspective view of the pad in an alternative embodiment with the pad in a folded state.
Figure 32:
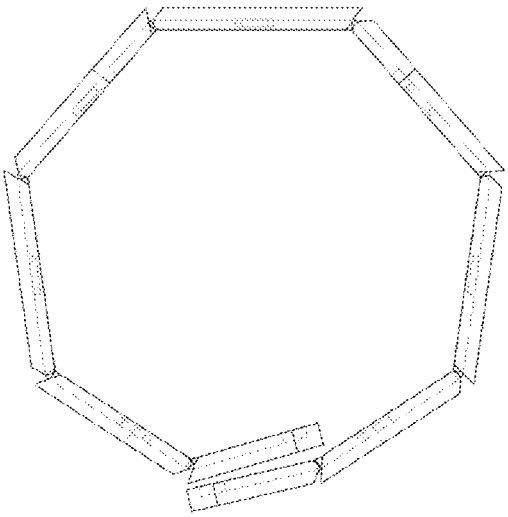
FIG. 32 is a top view of the pad in an alternative embodiment with the pad in a folded state.

Turning now to FIGS. 31 and 32, a pad 72 in a rolled up state according to an embodiment of the present invention is shown.

Figure 33:
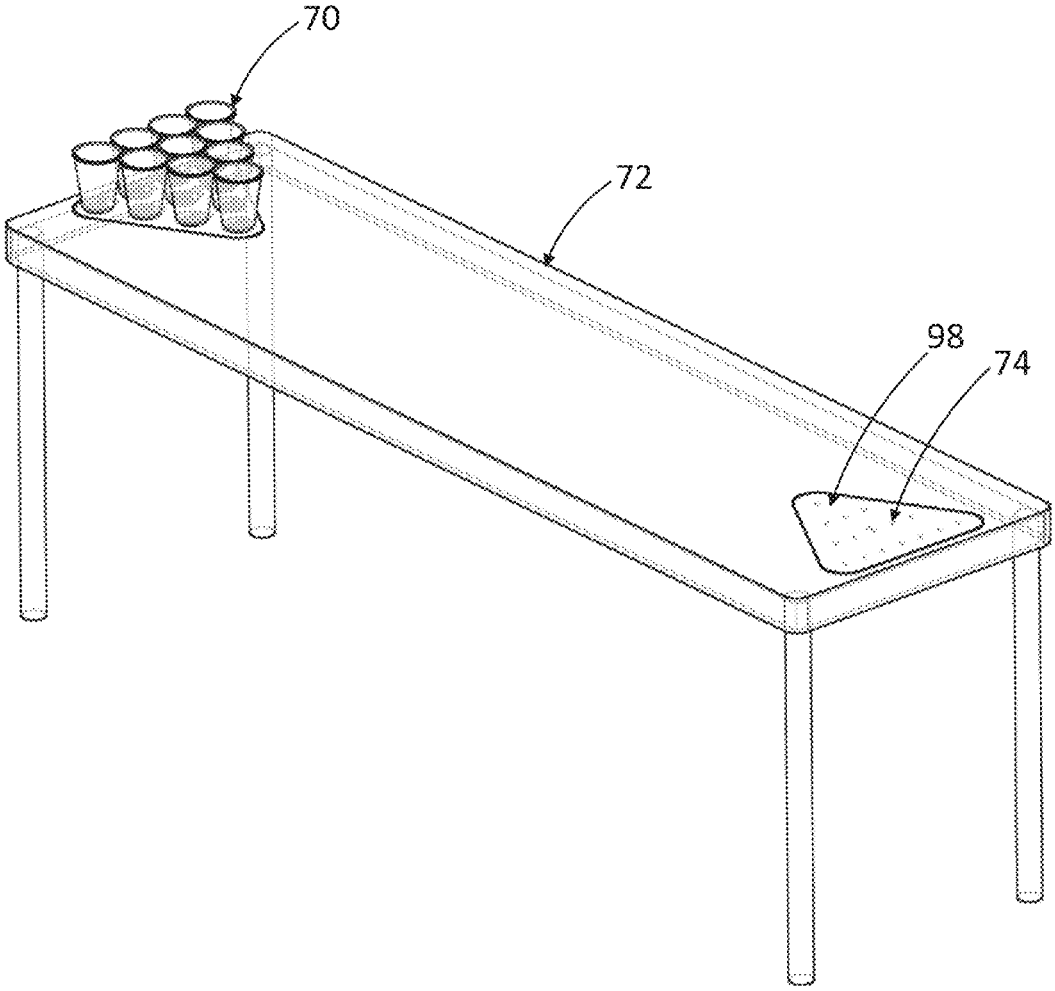
FIG. 33 is a 3-D perspective view of an alternative embodiment.
Figure 34:
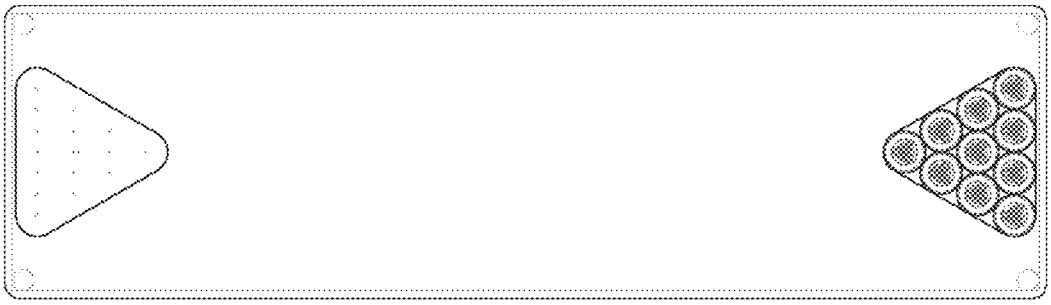
FIG. 34 is a top view of an alternative embodiment.
Figure 35:
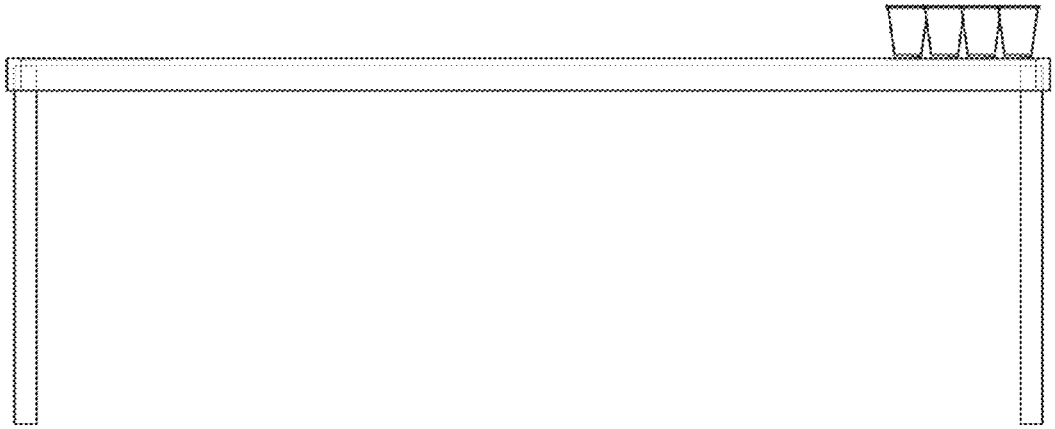
FIG. 35 is a side view of an alternative embodiment.

Additional Embodiment—FIG. 33-35

One additional embodiment of present invention is illustrated in FIGS. 33, 34 and 35.

According to an embodiment of present invention, the pad 72 has the geometry of a table.

In a preferred embodiment, the pad 72 can be placed on the ground and have sufficient height and length to be used for drinking games. In this embodiment there are a series of alignment part mating component holes 80 at each end of the pad 72. In this embodiment there are thirty four alignment part mating component holes 80 and thirty four alignment part mating components 74. In other embodiments there may be more than thirty four alignment part mating component holes 80 and alignment part mating components 74 or there may be less. In this embodiment there are two caps 98 which seal the alignment part mating components 74 into the alignment part mating component holes 80. In other embodiments there may be more than two caps 98 or there may be less, or there may be no caps 98 at all.

This embodiment may be easier to use because the user does not need to install the pad 72 onto another surface. In other words the pad 72 is free standing, supports itself, and provides the structure and dimensions necessary for a variety of drinking games.

Additional Embodiment—FIG. 36-40C

An additional embodiment of a cup 70 of the present invention is illustrated in FIGS. 36, 37, 38, 39, 40A, 40B, and 40C.

Turning now to FIGS. 36, 37, 38, and 39 a cup 70 in accordance with an embodiment of the present invention is shown. According to a preferred embodiment, the alignment part 76 is pressed in to the base 88 of the cup 70. The alignment part 76 may be heated during assembly to ensure a more secure attachment to the cup 70.

Figure 36:
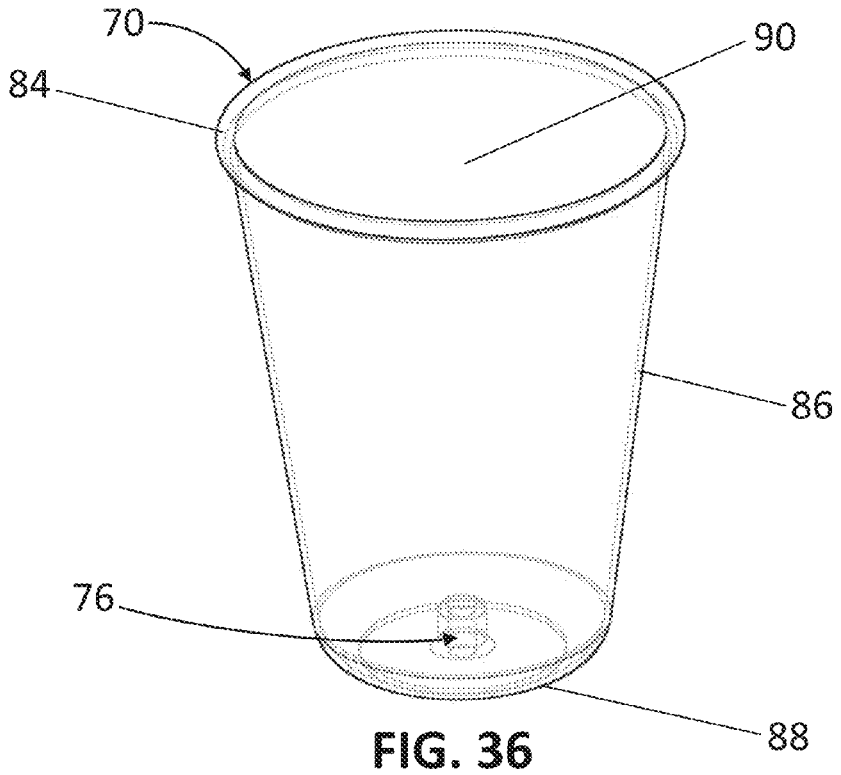
FIG. 36 is a 3-D perspective view of the cup in an alternative embodiment.
Figure 37:
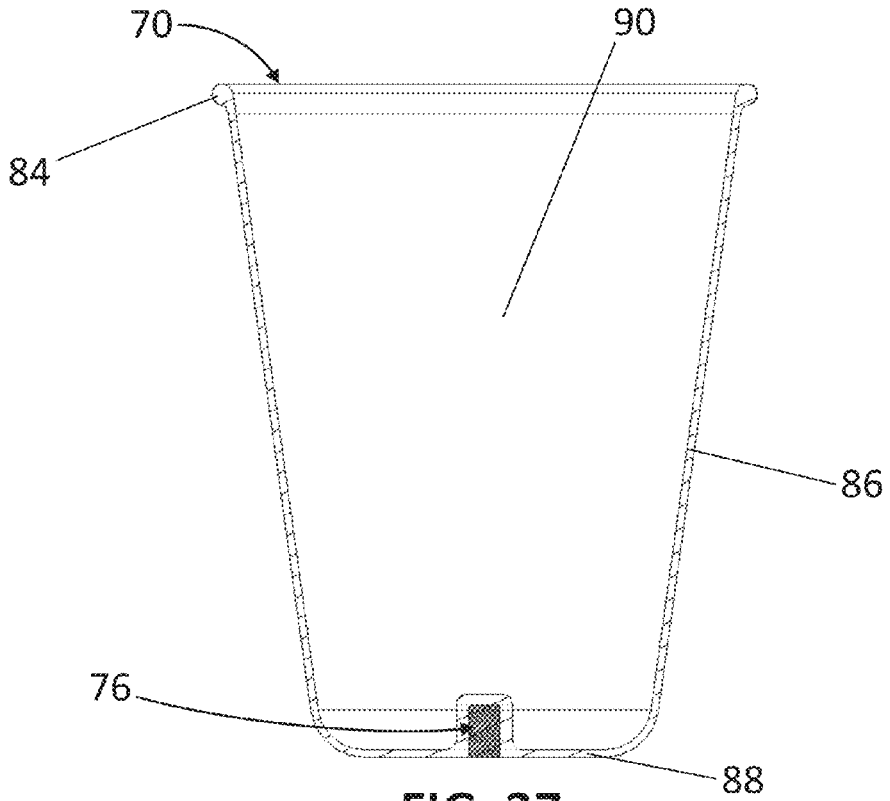
FIG. 37 is a cross sectional side view of the cup in an alternative embodiment.
Figure 38:
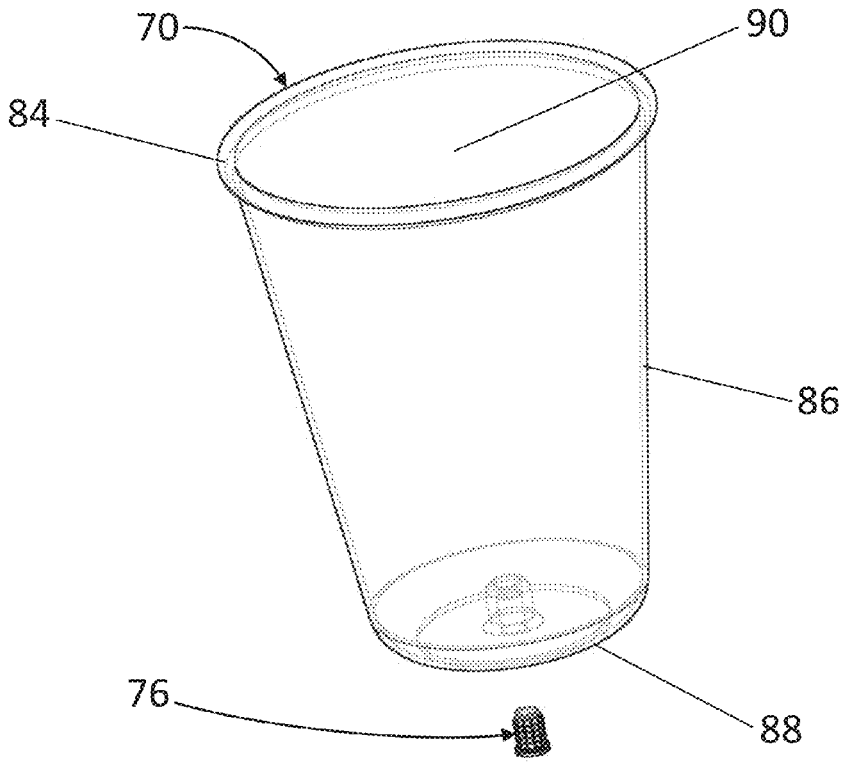
FIG. 38 is an exploded 3-D perspective view of the cup in an alternative embodiment.
Figure 39:
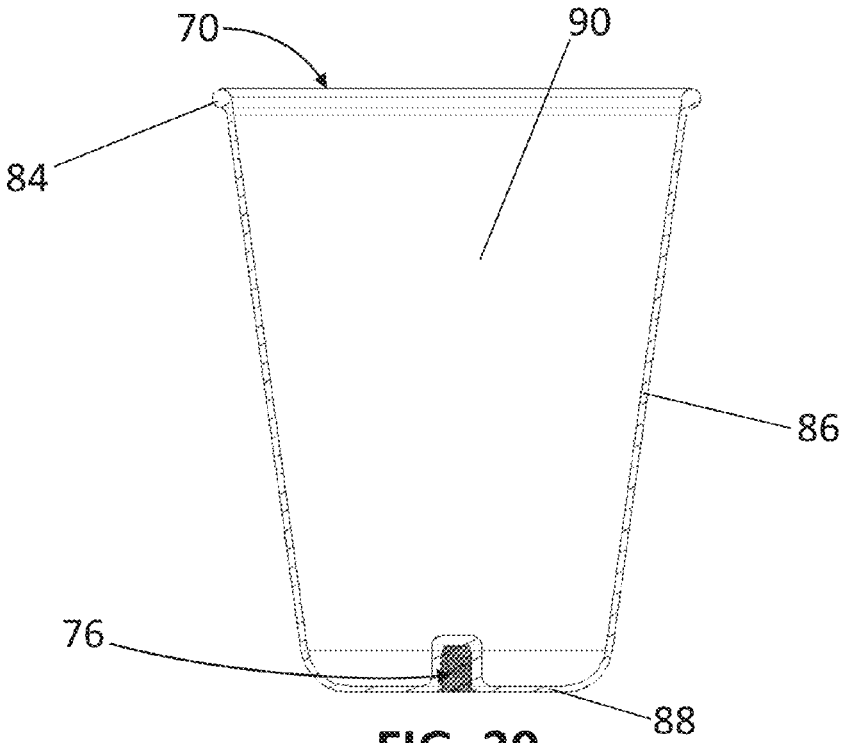
FIG. 39 is a cross sectional side view of the cup in an alternative embodiment.
Figure 40A:
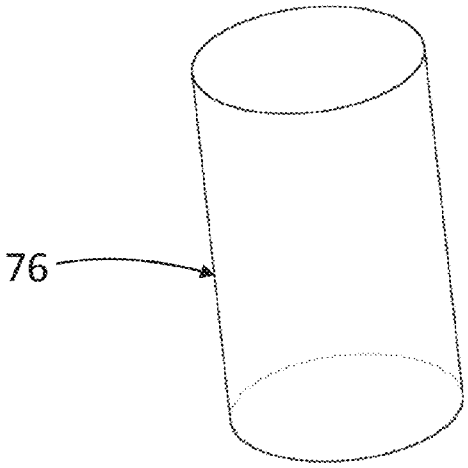
FIG. 40A is a 3-D perspective view of an alternative embodiment of the alignment part.
Figure 40B:
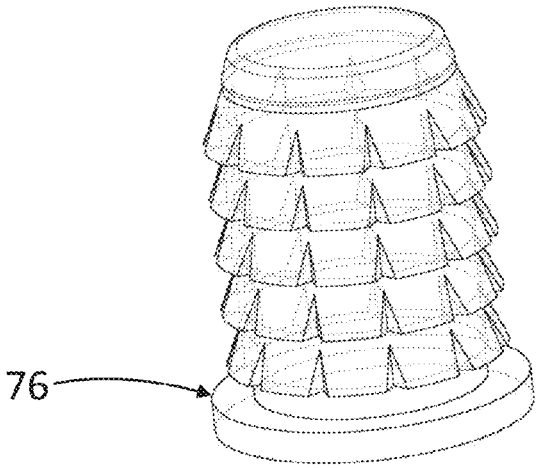
FIG. 40B is a 3-D perspective view of an alternative embodiment of the alignment part.
Figure 40C:
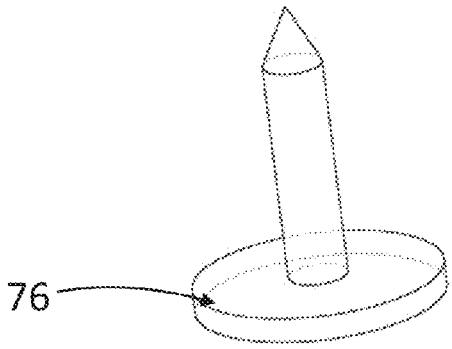
FIG. 40C is a 3-D perspective view of an alternative embodiment of the alignment part.

Turning now to FIGS. 40A, 40B, and 40C the different shapes or geometries that the alignment part 76 may have in accordance with an embodiment of the present invention. FIG. 36 and FIG. 37 show an embodiment of the cup 70 using the embodiment of the alignment part shown in FIG. 40A. FIG. 38 and FIG. 39 show an embodiment of the cup 70 of using the embodiment of the alignment part shown in FIG. 40B.

The embodiment shown in FIGS. 36, 37, 38, and 39 may be easier or less costly to manufacture. Also, because there is no material below the alignment part 76 in the cup 70, the distance between the alignment part 76 and the alignment part mating component 74 in the pad 72 may be small.

Figure 41:
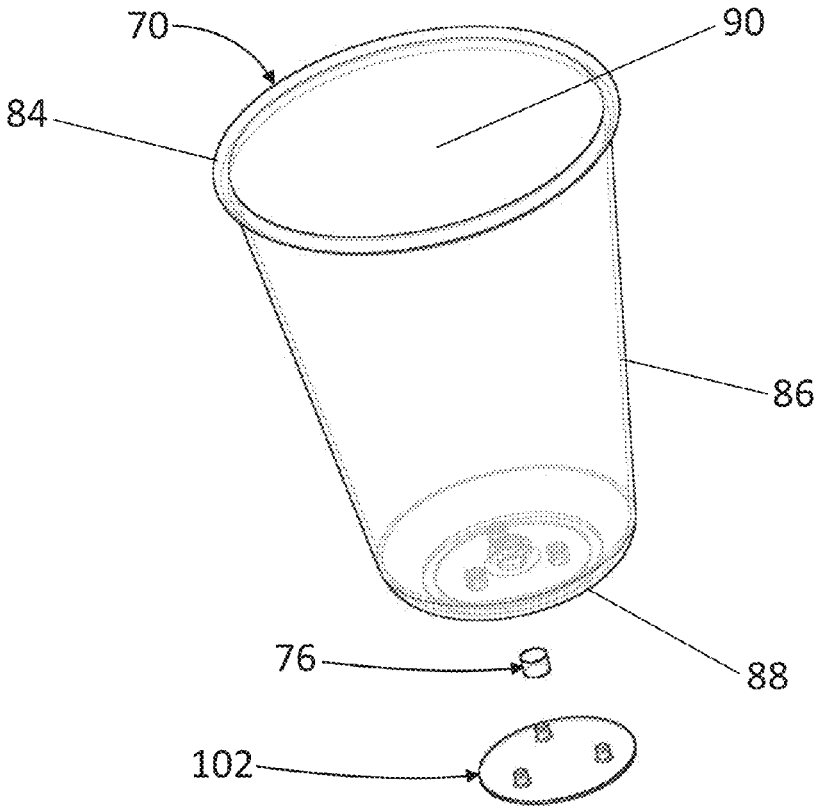
FIG. 41 is an exploded 3-D perspective view of the cup in an alternative embodiment.
Figure 42:
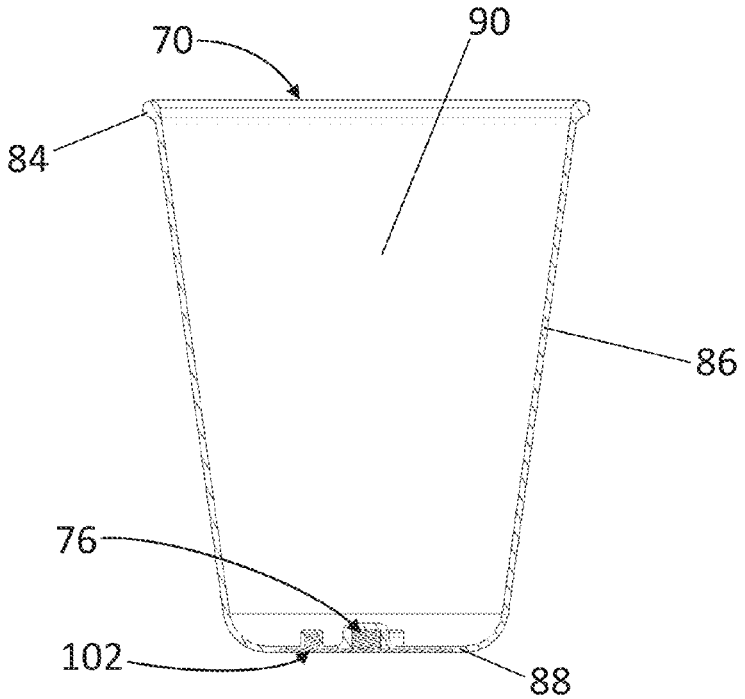
FIG. 42 is a cross sectional side view of the cup in an alternative embodiment.

Additional Embodiment—FIG. 41-42

An additional embodiment of a cup 70 of the present invention is illustrated in FIG. 41 and FIG. 42.

According to an embodiment of the present invention, there is a capturing part or seal 102. In a preferred embodiment, the seal 102 could be press fit, attached using adhesive, secured by snap features, heat staked, ultrasonically welded, or fastened by some other means to the cup 70.

According to an embodiment of present invention, the seal 102 may be a different size or shape than the one depicted in FIG. 41 and FIG. 42.

According to an embodiment of present invention, the seal 102 may be made of plastic. In a preferred embodiment, the seal 102 may be made of polypropylene. In alternate embodiments, the seal 102 may be made of another type of plastic or any other suitable material or combination thereof.

According to an embodiment of present invention, the seal 102 secures, retains, or captures the alignment part 76 within the base 88 of the cup 70. In certain embodiments, the seal 102 may protect the alignment part 76 from the external environment and prevent the alignment part 76 from falling out of the base 88 of the cup 70.

According to an embodiment of present invention, the seal 102 may also be used to increase or decrease the amount of grip or traction between the cup 70 and the pad top surface 78.

Additional Embodiment—FIG. 43-47

An additional embodiment of a cup 70 is illustrated in FIGS. 43, 44, 45, 46, and 47.

Figure 43:
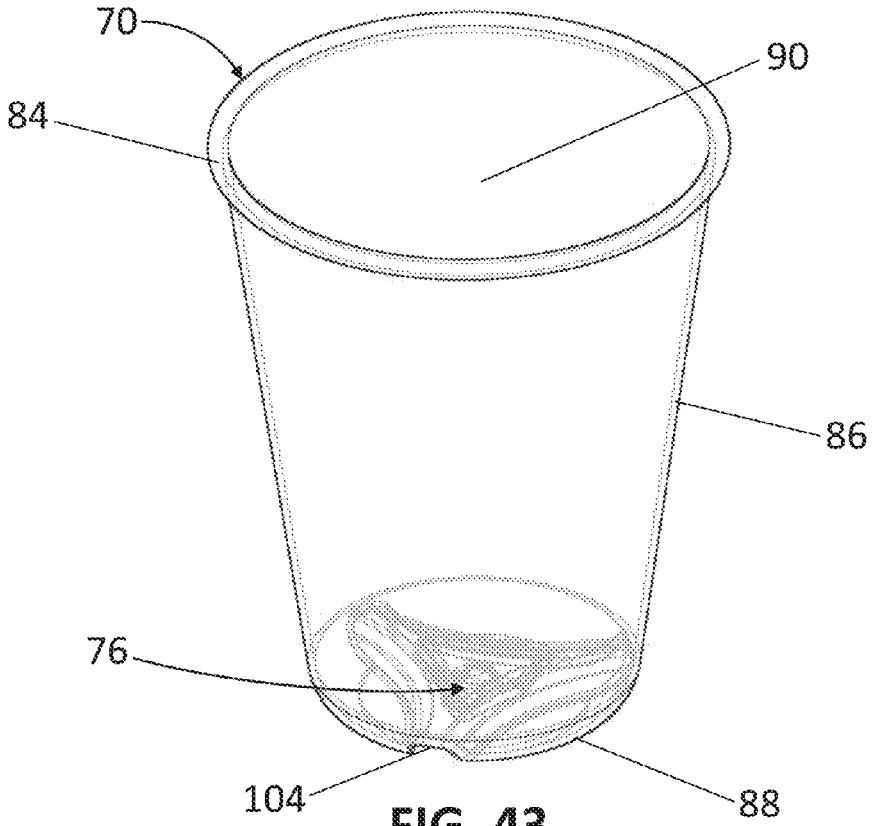
FIG. 43 is a 3-D perspective view of the cup in an alternative embodiment.
Figure 44:
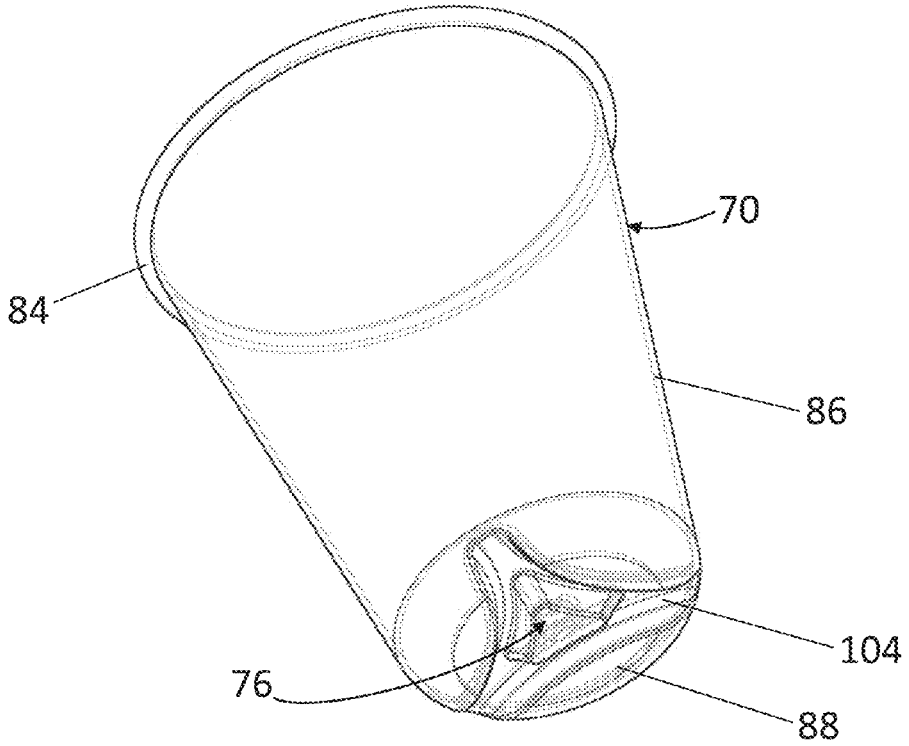
FIG. 44 is a 3-D perspective view showing the bottom of the cup in an alternative embodiment.

Turning now to FIG. 43 and FIG. 44 a cup 70 in accordance with an embodiment of the present invention is shown. In a preferred embodiment, the base 88 of the cup 70 has a cutout, void, notch, or stacking groove 104. The shape and size of the stacking groove 104 may vary in other embodiments. In other embodiments there may be a number of additional stacking grooves 104, or there may be no stacking grooves 104 at all.

Figure 45:
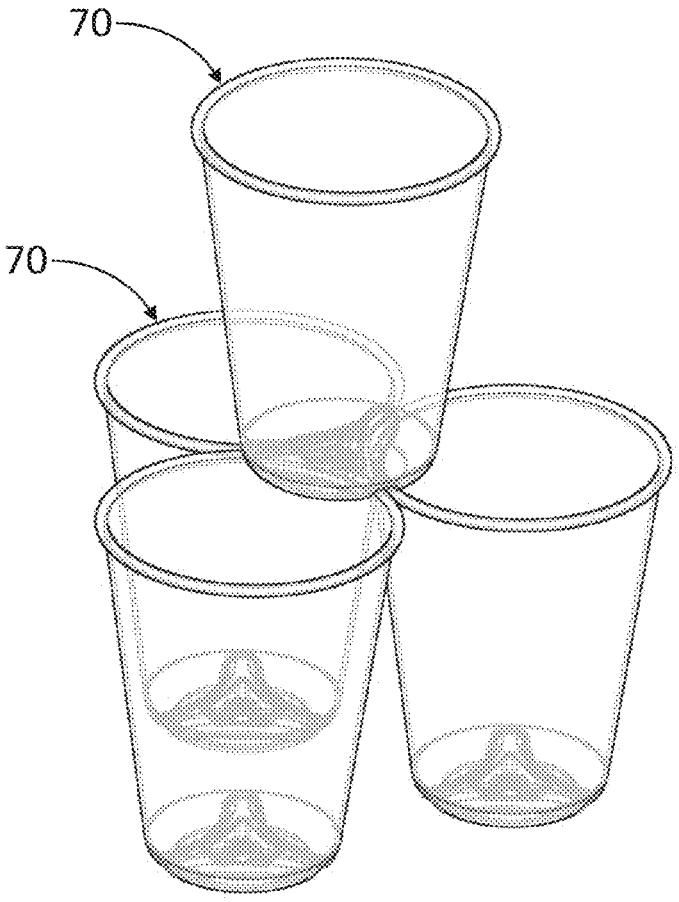
FIG. 45 is a 3-D perspective view showing one cup stacked on top of three cups.
Figure 46:
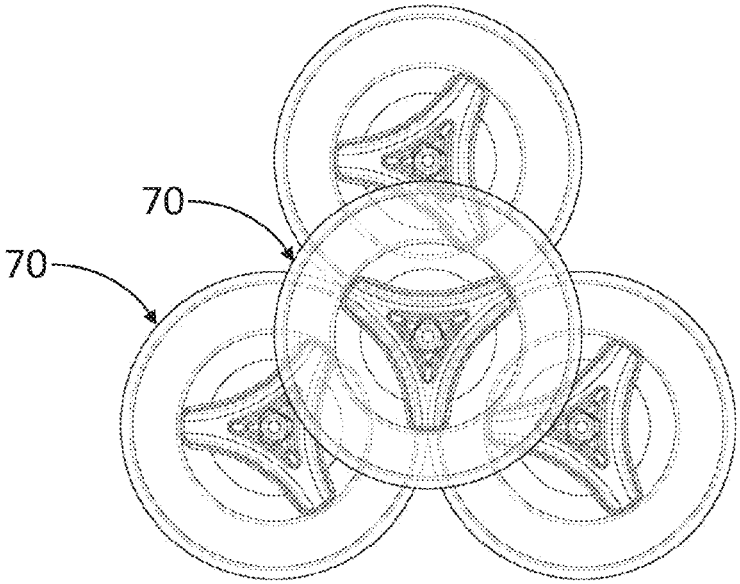
FIG. 46 is a top view showing one cup stacked on top of three cups.
Figure 47:
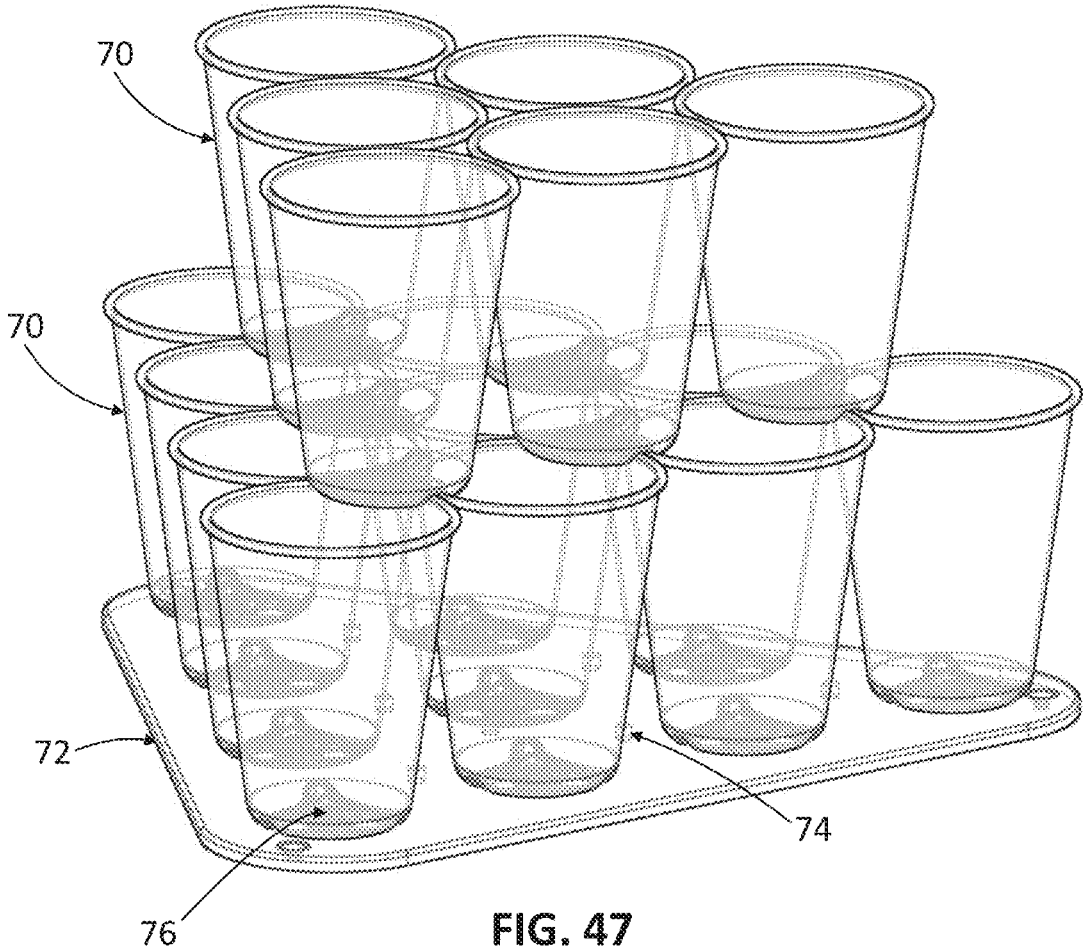
FIG. 47 is a 3-D perspective view showing six cups stacked on top of ten cups.

Turning now to FIG. 45 and FIG. 46 a stack of cups 70 in accordance with an embodiment of the present invention is shown. In a preferred embodiment, the geometry of the stacking groove 104 allows the user to vertically stack a cup 70 upon or above three other cups 70 to a racked arrangement. The geometry of the stacking groove 104 is such that when a cup 70 is stacked on top of other cups 70 it may be more securely connected to and aligned with the cups 70 below. This allows users to form new vertical or three-dimensional racks or cup arrangements that would otherwise not be possible, or would be very likely to fall or collapse if attempted with existing cups. FIG. 45 and FIG. 46 show one cup 70 stacked on top of three cups 70. FIG. 47 shows this embodiment with sixteen cups 70. In FIG. 47 ten cups 70 are shown on the pad 72 with an additional six cups 70 stacked on top.

Figure 48:
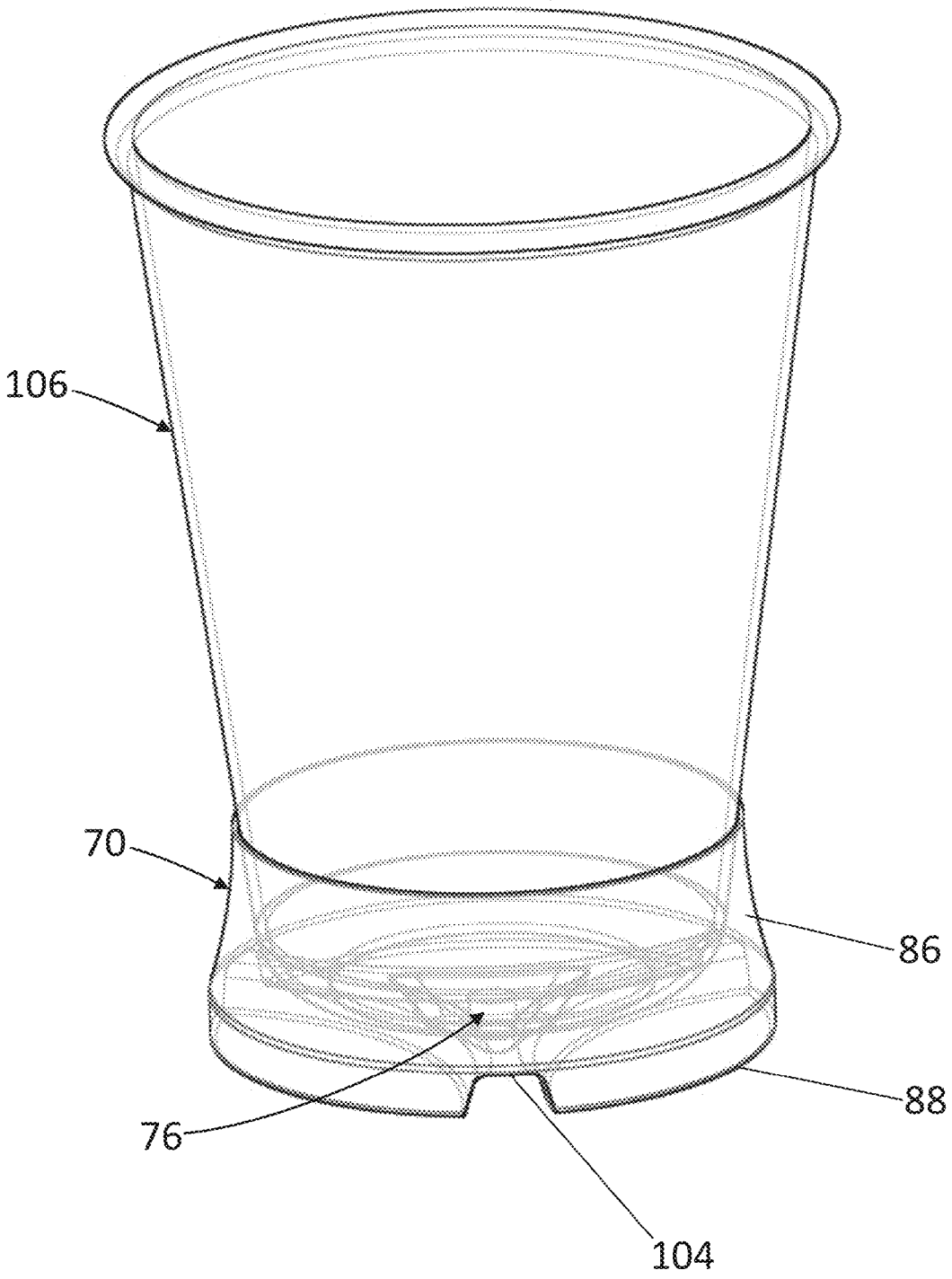
FIG. 48 is a 3-D perspective view of the cup in an alternative embodiment.
Figure 49:
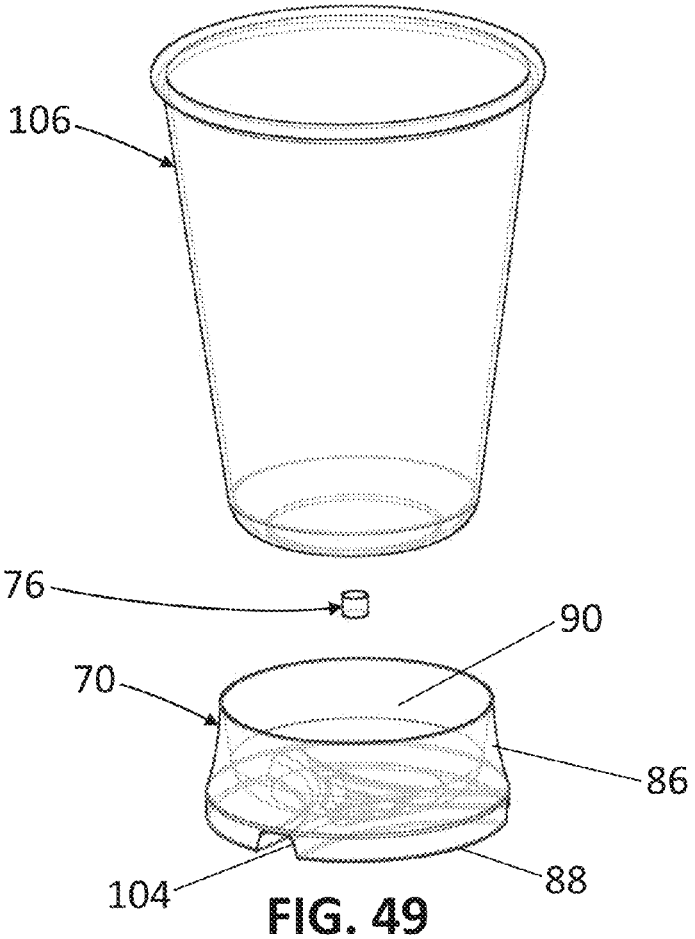
FIG. 49 is an exploded 3-D perspective view of the cup in an alternative embodiment.
Figure 50:
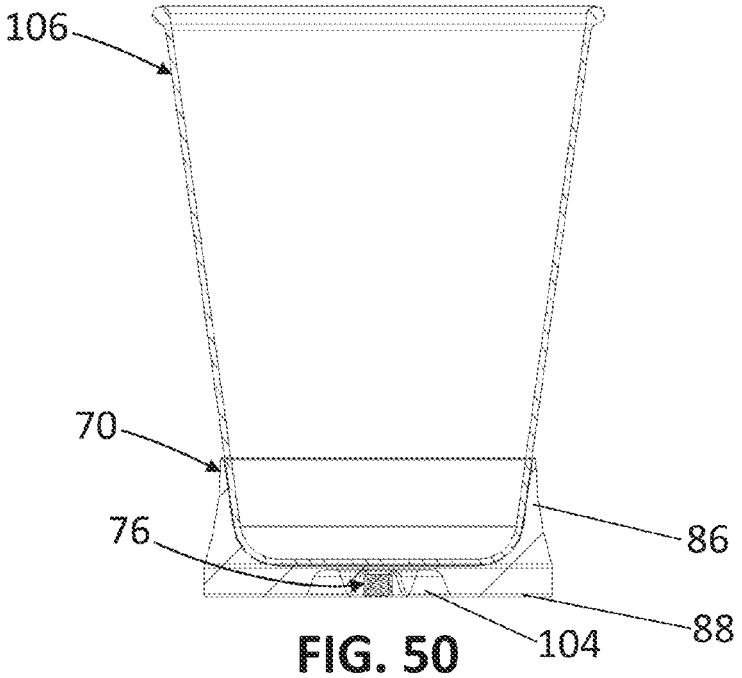
FIG. 50 is a cross sectional side view of the cup in an alternative embodiment.

Additional Embodiment—FIG. 48-50

An additional embodiment of a cup 70 is illustrated in FIGS. 48, 49, and 50.

Turning now to FIG. 48, FIG. 49 and FIG. 50 a cup 70 in accordance with an embodiment of the present invention is shown. According to an embodiment of present invention, the cup 70 is intended to be used in conjunction or combination with a standard beverage container 106 (e.g. standard plastic cup, disposable plastic cup, traditional drinking cup). In a preferred embodiment, the standard beverage container 106 can be inserted into, pressed into, or attached into the containment space 90 of the cup 70 in this embodiment. The geometry of the containment space 90 may vary in other embodiments to accommodate insertion of, or attachment to, various other sizes and types of standard beverage container 106.

According to a preferred embodiment of present invention, the cup 70 may be made of rubber foam, open cell foam, or neoprene. In alternate embodiments, other materials may also be suitable, including plastic or wood. In certain embodiments, an insulating material may be used for the cup 70 having the additional benefit of keeping the contents of the standard beverage container 106 cooler for an extended period of time.

Figure 51:
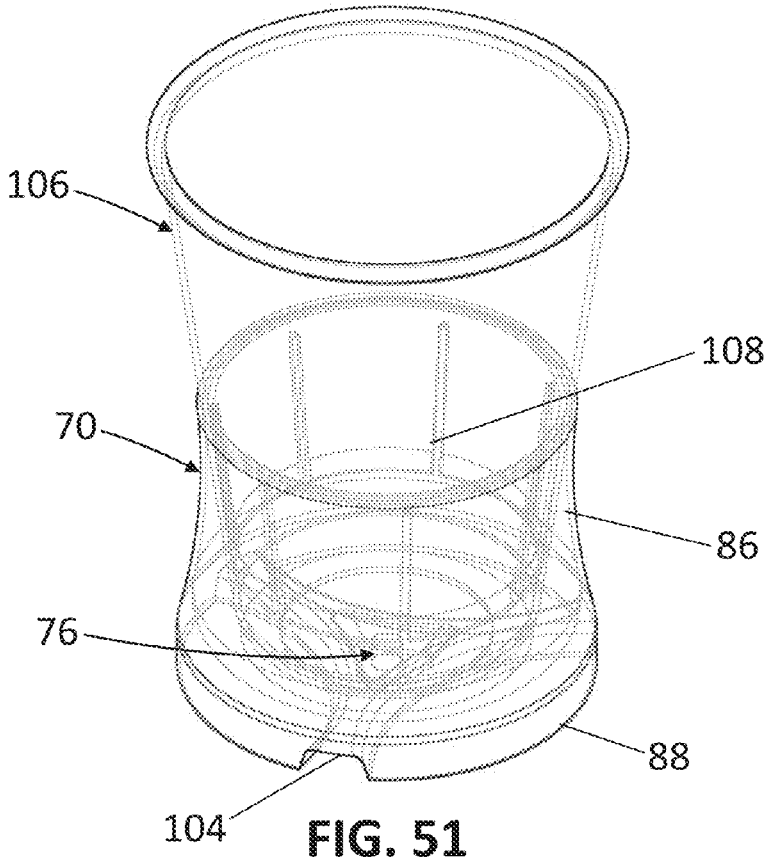
FIG. 51 is a 3-D perspective view of the cup in an alternative embodiment.
Figure 52:
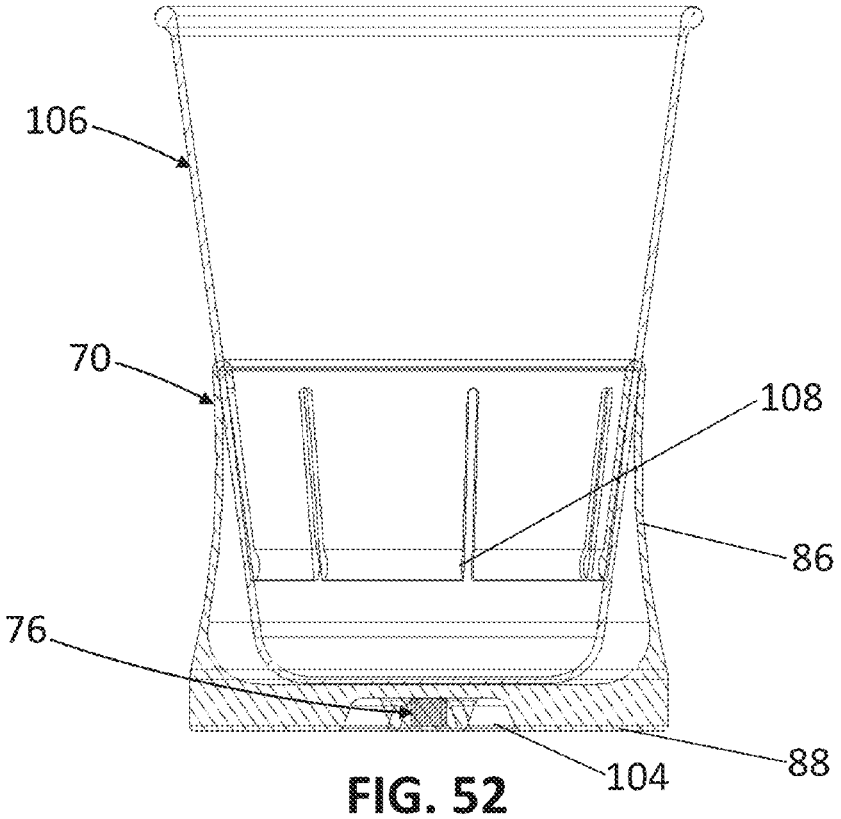
FIG. 52 is a cross sectional side view of the cup in an alternative embodiment.
Figure 53:
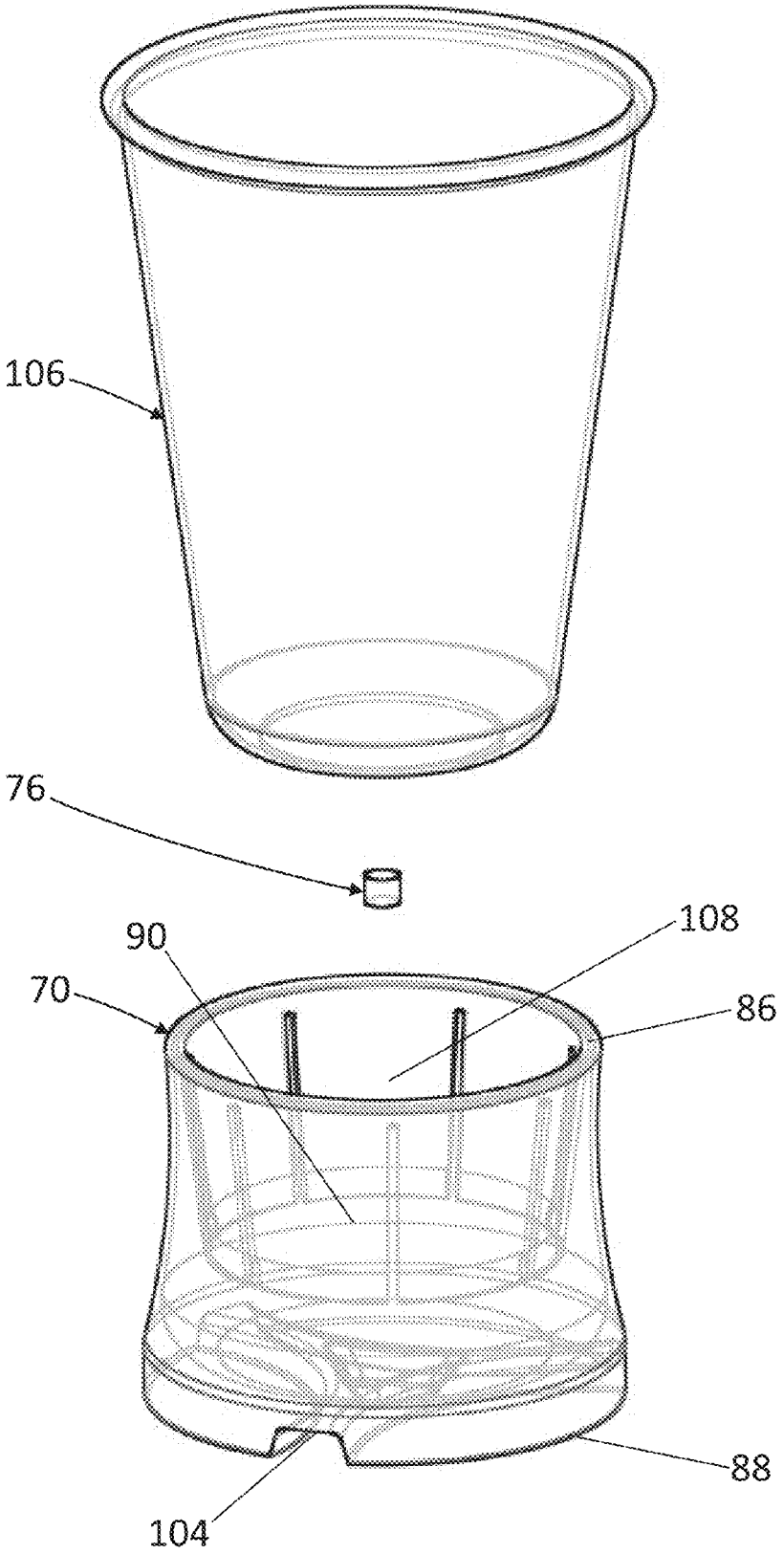
FIG. 53 is an exploded 3-D perspective view of the cup in an alternative embodiment.

Additional Embodiment—FIG. 51-53

An additional embodiment of a cup 70 is illustrated in FIGS. 51, 52, and 53.

Turning now to FIG. 51, FIG. 52 and FIG. 53 a cup 70 in accordance with an embodiment of the present invention is shown. According to an embodiment of the present invention, the cup 70 is intended to be used in conjunction or combination with the standard beverage container 106 in a similar fashion as the previously mentioned embodiment. In a preferred embodiment, the standard beverage container 106 can be inserted into or attached into the containment space 90 of the cup 70. This embodiment differs from the previous embodiment in that the wall 86 within the containment space 90 is split into a number of snap fingers, flexible fingers, or retaining fingers 108. The geometry of the retaining fingers 108 may vary in other embodiments to accommodate insertion of, or attachment to, various other sizes and types of standard beverage container 106.

According to an embodiment of the present invention, the cup 70 may be made of plastic. In a preferred embodiment, the cup 70 may be made from polypropylene. On of ordinary skill in the art would appreciate there are many materials the cup 70 might be made from, and embodiments of the present invention are contemplated for use with any such material.

Advantages

The Drinking Game Cup or Attachment with Magnetic Alignment Pad comprising any feature described, either individually or in combination with any feature in any embodiment, may have one or more of the following advantages:

Improves the consistency of game play;

Improves the quality of game play;

Improves the quality of drinking game cup arrangements, also known as "racks";

Improves the consistency of drinking game cup arrangements, also known as "racks";

Reduces the amount of time required to form a rack;

Improves the precision of rack arrangements and alignments;

Improves the orientation of rack arrangements and alignments;

Improves the stability of rack arrangements;

Easier to use than existing products;

Allows drinking game players to form racks, or cup arrangements, which were previously difficult or impossible to form;

Allows vertical stacking of a drinking game cup on the rims of a cups below;

Reduces the likelihood of undesired movement during game play;

Reduces the likelihood of spilling contents of cup;

Increases the amount of time the contents of a user's cup may remain at a desired temperature;

Easier to aim at; and

Easier to manufacture or mass produce.

Conclusion, Ramifications, and Scope

While the above description contains many specificities, these should not be construed as limitations on the scope, but rather as an exemplification of one [or several] preferred embodiment thereof. Many other variations are possible. Specifically, throughout this disclosure many references are made to a alignment part mating component 74, and alignment part 76, and a alignment part mating component hole 80. It should also be appreciated that the alignment part 76, could be any suitable component that could be used to align the cup 70 on a playing surface, including, but not limited to a friction fit mechanism or alignment hole. It should also be appreciated that the alignment part mating component 74 could be replaced with any other means that would be suitable for aligning the cup 70, including, but not limited to, a friction fit mechanism, alignment post, or any other component that could operably interact with the alignment part 76 of the cup 70. Similarly, the alignment part mating component hole 80 could be configured to receive any of the previously mentioned alignment means that could be used to replace the alignment part mating component 74.

Additionally, a number of material coloration techniques or approaches could be employed to improve the visual contrast between individual features or components. This could make the embodiment easier to target or aim at.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A drinking game apparatus, the drinking game apparatus comprising:

an alignment pad adapted to provide a plurality of cup arrangement patterns, wherein the entire top surface of said alignment pad is flat and smooth;

one or more magnetic components embedded in said top surface of said alignment pad;

one or more cups, wherein each of said cups has a position on said alignment pad corresponding to one of said magnetic components, wherein said magnetic components are spaced apart from each other by a rim diameter of said one or more cups;

a magnetic alignment part centrally embedded in a base of each of said one or more cups, wherein said magnetic alignment part is configured to magnetically couple with one of said magnetic components in said alignment pad when said magnetic alignment part in said cup is proximate one of said magnetic components in said alignment pad in order to magnetically hold said cup in position and to align the cups so that their rims tend to stay in contact for game play; and a groove pattern on their respective base configured to engage respective rim segments of three triangularly adjacent cups, thereby providing a stable stackable arrangement in which one cup sits atop a group of three triangularly adjacent cups below.

2. The apparatus of claim 1, wherein said magnetic alignment part is integrally formed in said base of said cup.

3. The apparatus of claim 1, wherein said one or more cups is a beverage container.

4. The apparatus of claim 1, wherein said one or more cups is configured with a containment space adapted to receive a beverage container.

5. The apparatus of claim 1, wherein said alignment pad is used to align one or more drinking game components in relation to one another.

6. The apparatus of claim 1, wherein said one or more magnetic components embedded in said alignment pad are covered by one or more caps.

7. The apparatus of claim 1, wherein said one or more cups serve as a receptacle for a beverage container.

8. The apparatus of claim 1, wherein said magnetic components in said alignment pad and said magnetic alignment part in said one or more cups have equal diameters.

9. A drinking game apparatus, the drinking game apparatus comprising:

an alignment pad, adapted to provide a plurality of cup arrangement patterns, wherein the entire top surface of said alignment pad is flat and smooth;

one or more magnetic components embedded in said top surface of said alignment pad;

one or more cups, wherein each of said cups has a position on said alignment pad corresponding to one of said magnetic components, wherein said magnetic components are spaced apart from each other by a rim diameter of said one or more cups; and a magnetic alignment part centrally embedded in a base of each of said one or more cups, wherein said magnetic alignment part is configured to magnetically couple with one of said magnetic components in said alignment pad when said magnetic alignment part in said cup is proximate one of said magnetic components in said alignment pad in order to magnetically hold said cup in position and to align the cups so that their rims tend to stay in contact for game play, wherein said alignment pad is configured to be rolled up into a free standing cylindrical storage sleeve in which said one or more cups may be stowed.

10. The apparatus of claim 9, wherein said magnetic alignment part is integrally formed in said base of said cup.

11. The apparatus of claim 9, wherein said magnetic components in said alignment pad and said magnetic alignment part in said one or more cups have equal diameters.

12. The apparatus of claim 9, wherein said alignment pad is used to align one or more drinking game components in relation to one another.

13. The apparatus of claim 9, wherein said one or more magnetic components embedded in said alignment pad are covered by one or more caps.

14. The apparatus of claim 9, wherein said one or more cups serve as a receptacle for a beverage container.

15. A drinking game apparatus, the drinking game apparatus comprising:

an alignment pad, adapted to provide a plurality of cup arrangement patterns, and configured to be folded along eight folding notches into a free standing polygonal storage receptacle, wherein the entire top surface of said alignment pad is flat and smooth;

one or more magnetic components embedded in said top surface of said alignment pad;

one or more cups, wherein each of said cups has (1) a position on said alignment pad corresponding to one of said magnetic components, wherein said magnetic components are spaced apart from each other by a rim diameter of said one or more cups; and (2) a magnetic alignment part centrally embedded in a base of each of said one or more cups, wherein said magnetic alignment part is configured to magnetically couple with one of said magnetic components in said alignment pad when said magnetic alignment part in said cup is proximate one of said magnetic components in said alignment pad in order to magnetically hold said cup in position and to align the cups so that their rims tend to stay in contact for game play.

16. The apparatus of claim 15, wherein said magnetic alignment part is integrally formed in said base of said cup.

17. The apparatus of claim 15, wherein said magnetic components in said alignment pad and said magnetic alignment part in said one or more cups have equal diameters.

18. The apparatus of claim 15, wherein said alignment pad is used to align one or more drinking game components in relation to one another.

19. The apparatus of claim 15, wherein said one or more magnetic components embedded in said alignment pad are covered by one or more caps.

20. The apparatus of claim 15, wherein said one or more cups serve as a receptacle for a beverage container.

* * * * *